US008746321B2

(12) United States Patent
Miller

(10) Patent No.: US 8,746,321 B2
(45) Date of Patent: Jun. 10, 2014

(54) BASE SLAT RETENTION AND MOTOR TRIGGERING FOR ROLLING PROTECTIVE SHUTTERS

(75) Inventor: James V. Miller, Glen Ellyn, IL (US)

(73) Assignee: Qualitas Manufacturing, Inc., Itasca, IL (US)

( * ) Notice: Subject to any disclaimer, the term of this patent is extended or adjusted under 35 U.S.C. 154(b) by 69 days.

(21) Appl. No.: 13/222,844

(22) Filed: Aug. 31, 2011

(65) Prior Publication Data

US 2013/0048231 A1 Feb. 28, 2013

(51) Int. Cl.
*E06B 9/70* (2006.01)

(52) U.S. Cl.
USPC ..... 160/310; 160/7

(58) Field of Classification Search
USPC ..... 160/7, 310, 311, 188, 189, 201, 168.1 P, 160/DIG. 17; 49/28, 31, 199
See application file for complete search history.

(56) References Cited

U.S. PATENT DOCUMENTS

| | | | | | |
|---|---|---|---|---|---|
| 1,918,415 | A | | 7/1933 | Miller | |
| 2,449,264 | A | | 9/1948 | Wilkinson | |
| 2,492,721 | A | * | 12/1949 | Vita | 160/100 |
| 3,269,455 | A | | 8/1966 | Gillotti | |
| 3,603,372 | A | * | 9/1971 | Dietzsch | 160/168.1 P |
| 3,668,808 | A | | 6/1972 | Perina | |
| 3,835,911 | A | * | 9/1974 | Horst et al. | 160/168.1 R |
| 4,068,428 | A | | 1/1978 | Peterson, III | |
| 4,072,404 | A | * | 2/1978 | Brown | 359/461 |
| 4,610,116 | A | * | 9/1986 | Schulz | 52/200 |
| 4,690,195 | A | * | 9/1987 | Taylor | 160/310 |
| 4,887,660 | A | * | 12/1989 | Kraus | 160/265 |
| 5,088,543 | A | * | 2/1992 | Bilbrey | 160/310 |
| 5,245,879 | A | * | 9/1993 | McKeon | 74/2 |
| 5,341,241 | A | * | 8/1994 | Shopp | 359/443 |
| 5,353,152 | A | * | 10/1994 | Realmuto | 359/461 |
| 5,372,173 | A | * | 12/1994 | Horner | 160/98 |
| 5,575,322 | A | | 11/1996 | Miller | |
| 5,584,331 | A | * | 12/1996 | Lin | 160/172 R |
| 5,657,805 | A | | 8/1997 | Magro | |
| 5,850,862 | A | | 12/1998 | Miller | |
| 5,938,136 | A | | 8/1999 | Miller | |
| 5,975,185 | A | | 11/1999 | Miller et al. | |
| 5,983,971 | A | | 11/1999 | Miller et al. | |
| 5,996,669 | A | | 12/1999 | Miller | |
| 6,012,260 | A | | 1/2000 | Hendrick et al. | |
| 6,021,837 | A | | 2/2000 | Miller | |
| 6,054,921 | A | | 4/2000 | Miller | |
| 6,085,822 | A | | 7/2000 | Miller | |
| 6,095,224 | A | * | 8/2000 | Miller | 160/133 |
| 6,095,225 | A | | 8/2000 | Miller | |
| 6,244,325 | B1 | | 6/2001 | Miller et al. | |
| 6,263,942 | B1 | | 7/2001 | Miller | |

(Continued)

*Primary Examiner* — David Purol
(74) *Attorney, Agent, or Firm* — Miller, Matthias & Hull LLP

(57) ABSTRACT

The present invention is directed to a rolling protective shutter having an improved stopping mechanism that prevents the shutter from completely rolling up onto the shutter support member, and that is hidden within the shutter housing or the side tracks. The stopping mechanism may include a limit switch operatively connected to a drive motor to detect a disposition of the base slat of the shutter curtain proximate the shutter housing. The limit switch may actuate to turn off the drive motor at an appropriate position to retain the base slat within the side tracks and to prevent damage to the shutter housing due to engagement by the base slat.

12 Claims, 16 Drawing Sheets

(56) References Cited

U.S. PATENT DOCUMENTS

| | | | | |
|---|---|---|---|---|
| 6,276,744 | B1 * | 8/2001 | Huber et al. | 296/155 |
| 6,302,179 | B1 | 10/2001 | Miller | |
| 6,374,551 | B1 | 4/2002 | Boilen et al. | |
| 6,422,289 | B1 | 7/2002 | Miller | |
| 6,453,975 | B2 | 9/2002 | Miller | |
| 7,413,000 | B2 | 8/2008 | Lin | |
| 2002/0108325 | A1 | 8/2002 | Hulls et al. | |
| 2005/0082020 | A1 | 4/2005 | Miller | |
| 2005/0205221 | A1 | 9/2005 | Miller | |
| 2005/0205222 | A1 | 9/2005 | Miller | |
| 2005/0205223 | A1 | 9/2005 | Miller | |
| 2006/0118251 | A1 | 6/2006 | Miller | |
| 2007/0028536 | A1 | 2/2007 | Pandorf | |
| 2007/0056696 | A1 | 3/2007 | Lin | |
| 2007/0095488 | A1 * | 5/2007 | Huang | 160/310 |
| 2007/0175603 | A1 | 8/2007 | Lin | |

* cited by examiner

BASE SLAT RETENTION AND MOTOR TRIGGERING FOR ROLLING PROTECTIVE SHUTTERS

BACKGROUND

The present invention is directed to a rolling protective shutter assembly which has a shutter curtain for covering a window or door opening that may be rolled up into a shutter housing when not in use, and in particular to a motor-driven shutter assembly configured to shut off the motor when the base slat is detected to be proximate the shutter housing, with the base slat being retained by the side tracks of the assembly to facilitate proper deployment of the shutter curtain when the motor operates to unroll the shutter curtain.

Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed with guide channels or side tracks on either side of the opening. When not in use, the Solomon shutter may be rolled up into a housing disposed at the upper end of the protective shutter.

Another type of rolling protective shutter is disclosed in U.S. Pat. No. 5,365,990 to Ueda. As shown in FIGS. 2 and 3 of that patent, the Ueda shutter is composed of a plurality of slats, each of which has an upper rearward hook extending longitudinally along the upper edge of the slat and a lower U-shaped recess extending longitudinally along the lower edge of the slat. The recess has a forward horizontal projection on a rear edge and extending longitudinally so that when the lower slat moves down under gravity, the hook of the lower slat bears on the horizontal projection of the upper slat. The Ueda shutter may be rolled up and unrolled in a similar manner as the Solomon shutter.

In rolling shutter systems such as the Solomon and Ueda shutters, a portion of the shutter must remain within the side tracks to prevent the shutter from completely rolling up onto the take-up roll within the shutter housing. In some applications, the base slat has a handle extending outwardly from the shutter. One way to stop the bottom of the shutter from entering the housing is to size the opening in the housing through which the shutter passes narrow enough so that the handle hits the housing. The bottom of the shutter will stop short of entering the housing, but in many installations the housing is fabricated from sheet metal that is easily bent if the shutter is rolled up too rapidly.

In another alternative for stopping the bottom of the shutter, metal braces are attached to the side tracks and extend inwardly into the opening so that they engage the handle as the shutter is rolled up. Although the braces are stronger than the sheet metal housing, the handle and the braces can be damaged from repeated metal-on-metal impacts. Both the handle and the braces can be bent, gouged or broken, thereby increasing the possibility that the entire shutter will roll up into the housing and causing deterioration of the appearance of the shutter system. Additionally, the shutter may make a loud bang when the metal handle impacts the metal braces.

One solution for manually operated shutters is provided in U.S. Pat. No. 6,095,224 to Miller (hereinafter "the Miller '224 patent"). In the Miller '224 patent, portions of the side tracks of the assembly extend upwardly into the shutter housing and include spring biased stop members. Locking members extend outwardly from either end of the base slat and beyond the width of the shutter curtain such that the locking members are engaged by the stop members as they approach or enter the shutter housing. Configured in this way, the stopping mechanism is not visible and, consequently, does not diminish the aesthetic qualities of the shutter assembly, and reduces the noise created when the shutter curtain reaches its limiting position.

While effective with manual shutters, such mechanical mechanisms generally are not applicable in motor-driven shutter assemblies due to the risk of damaging the motor when a load is applied to the shutter curtain by the stop mechanism. In currently known motor-driven shutter assemblies, the base slat is required to stay in the side tracks and cannot fully retract into the housing. In many cases, the base slat remains in the side tracks below the bottom of the shutter housing by 3" or more, thereby reducing the size of the opening. The side tracks do not extend upwardly into the shutter housing in a manner that would retain the base slat so that the remaining slats of the shutter curtain are free to roll up onto shutter support member. The base slat must remain in the side tracks in order to lead the slats back into the side tracks when the shutter curtain is unrolled, with gravity pulling the shutter into the tracks as the shutter curtain is dispensed from the shutter support member. Additional weights are sometimes required to guarantee that the shutter curtain will be dispensed correctly despite friction and other forces caused by the engagement of the shutter curtain by the components of the shutter assembly. If the base is retracted completely into the shutter housing, it may not find its way back into the side tracks.

In some implementations, the drive motors are provided with limit switches to attempt to cut off the motor when the shutter curtain is rolled up to a desired position. However, the limit switch typically operates based on the angular displacement of the shutter support member, and not the actual position of the shutter curtain. The position of the base slat can vary based on the tightness with which the shutter curtain is wrapped around the shutter support member. Additionally, an arrangement such as that shown in the Miller patent may be used with a motor driven shutter assembly to ensure that the base slat cannot be pushed up into the housing and out of the side tracks, and thereby causing a failure of the shutter assembly. If the shutter curtain equipped with the stopping mechanism rolls up slightly incorrectly, the limit switch on the motor may not be reached, thereby causing the shutter curtain and motor to be put under stress that can cause a failure of the curtain or the motor.

In other implementations, the drive motors are designed to sense when the shutter curtain is subjected to a load, and to shut off in response. The motors are specially made and adjusted to sense the correct torque at the stop position, and to not stop under the weight load of the shutter curtain when the curtain is drawing up. The motor also should not stop due to frictional forces that invariably will be present as the shutter curtain moves within the side tracks. These configurations still require the base slat to be at least partially disposed in the side tracks to function as a leader for the shutter curtain, and weight may need to be put in the base slat to ensure that the base slat moves downward in the side tracks to properly deploy the shutter curtain, and thereby affecting the adjustment of the drive motor. As can be seen, these solutions for motor driven shutter assemblies present performance risks relating to the proper deployment of the shutter curtain and potential damage to the shutter curtain and/or motor. Therefore, a need exists for an improved mechanism for stopping the motor when a particular part of the shutter curtain, such as the base slat, reaches the upper limit, and for allowing the base slat to be recessed within the shutter housing without compromising the ability of the shutter curtain to be unrolled back into the shutter tracks.

SUMMARY OF THE INVENTION

The present invention is directed to a rolling protective shutter having improved shutter tracks. The improved shutter tracks according to the present invention include an improved stopping mechanism that prevents the shutter from completely rolling up onto the shutter support member and is hidden within the shutter tracks and/or the housing.

According to one aspect of the present invention, a rolling shutter assembly includes rolling shutter assembly for covering an opening of a structure. The rolling shutter assembly may include a shutter housing mounted at the top of the opening, a shutter support member mounted within the shutter housing, and a shutter curtain connected to the shutter support member at a top edge of the shutter curtain. The shutter curtain may have a base slat connected to a bottom edge of the shutter curtain, wherein the shutter curtain is rolled up onto the shutter support member when the shutter support member rotates in a first direction and is unrolled from the shutter support member when the shutter support member rotates in a second direction. The rolling shutter assembly may further include a pair of side tracks mounted on opposite sides of the opening and receiving corresponding ends of the shutter curtain when the shutter curtain is unrolled, a drive motor coupled to the shutter support member to rotate the shutter support member in both the first direction and the second direction, and a limit switch operatively connected to the drive motor and disposed within the shutter housing. The limit switch may have a normal position allowing the drive motor to be actuated to rotate in the first direction and an actuated position preventing the drive motor from being actuated to rotate in the first direction, wherein the limit switch detects a disposition of at least a portion of the base slat within the shutter housing and actuates to turn off the drive motor when the base slat is raised to a predetermined position within the shutter housing.

According to another aspect of the present invention, a rolling shutter assembly for covering an opening of a structure may include a shutter housing mounted at the top of the opening and having an end cap with a motor housing, a shutter support member mounted within the shutter housing, and a shutter curtain connected to the shutter support member at a top edge of the shutter curtain. The shutter curtain may have a base slat connected to a bottom edge of the shutter curtain and having a guide arm extending outwardly from either side of the base slat, wherein the shutter curtain is rolled up onto the shutter support member when the shutter support member rotates in a first direction and is unrolled from the shutter support member when the shutter support member rotates in a second direction. The rolling shutter assembly may further include a pair of side tracks mounted on opposite sides of the opening, a drive motor disposed within the motor housing and coupled to the shutter support member to rotate the shutter support member in both the first direction and the second direction, a limit switch operatively connected to the drive motor and disposed within the motor housing, and a trigger mechanism operatively coupled to the limit switch and having a portion extending downwardly through an opening in a bottom surface of the shutter housing. Each side track may have a first channel receiving a corresponding end of the shutter curtain when the shutter curtain is unrolled and a second channel receiving a corresponding guide arm of the base slat, wherein the second channel extends upwardly into the shutter housing. The limit switch may be normally closed to allow the drive motor to be actuated to rotate in the first direction and being open when actuated to prevent the drive motor from being actuated to rotate in the first direction, and the base slat may engage the trigger mechanism to actuate the limit switch to open the limit switch and turn off the drive motor when the base slat is raised to a predetermined position within the shutter housing.

The features and advantages of the invention will be apparent to those of ordinary skill in the art in view of the detailed description of the preferred embodiments, which is made with reference to the drawings, a brief description of which is provided below.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
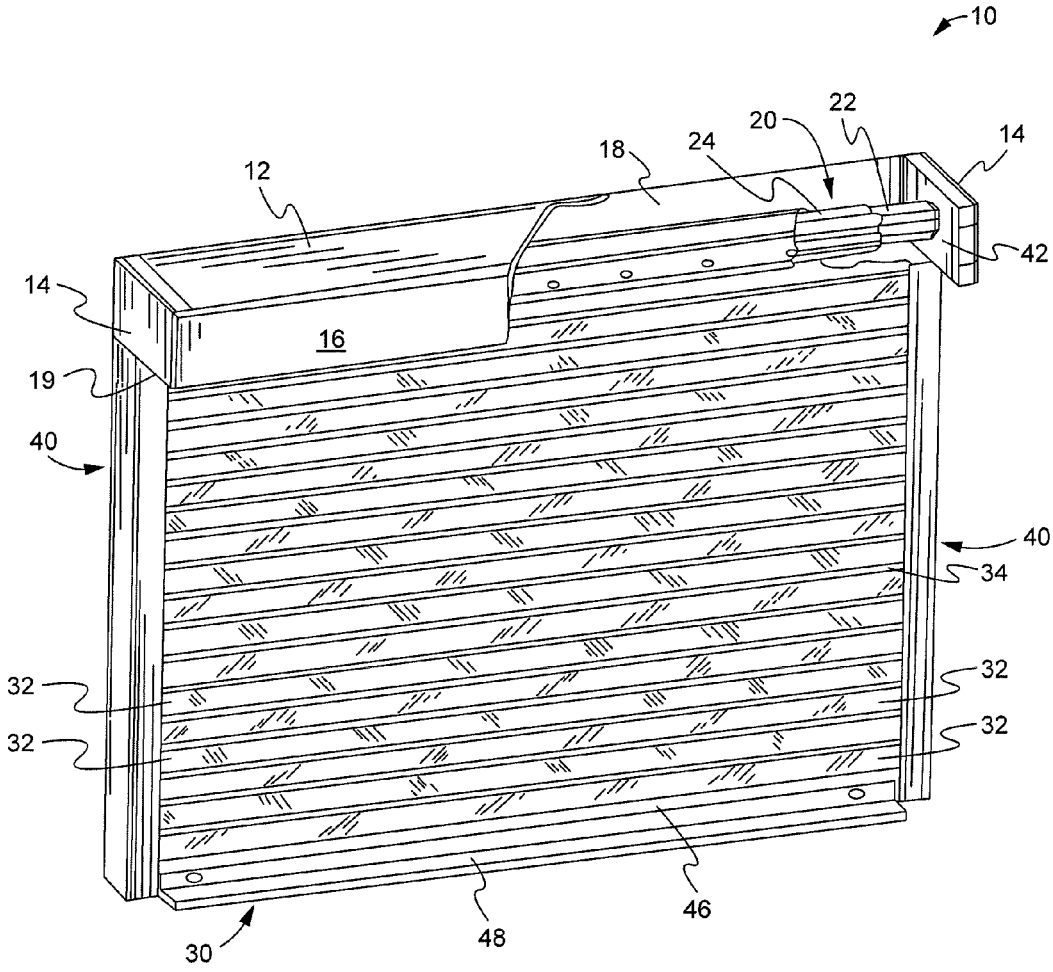
FIG. 1 is a perspective view of a rolling shutter assembly that can implement the present invention.
Figure 2:
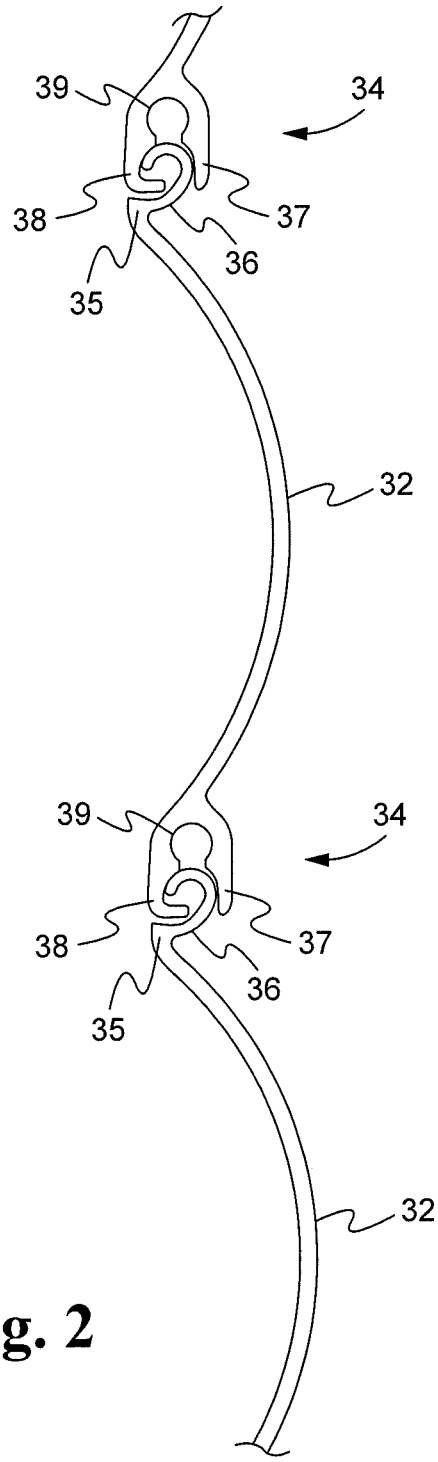
FIG. 2 is a side view of a portion of the shutter curtain of the shutter assembly of FIG. 1.
Figure 3:
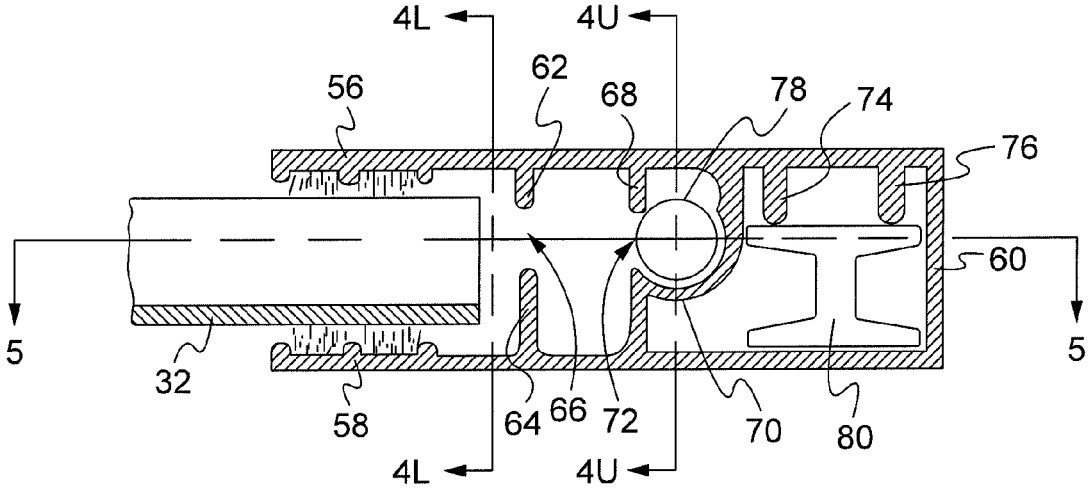
FIG. 3 is a cross-sectional bottom view of a portion of the shutter assembly of FIG. 1 taken along line 3-3.

One type of a rolling shutter assembly 10 that may implement the present invention is shown in FIGS. 1-3. Referring to FIG. 1, the shutter assembly 10 has a shutter housing which includes a top wall 12, a pair of side walls or end caps 14, a front wall 16, a rear wall 18 and a bottom wall 19. In many implementations, the top wall 12, rear wall 18 and an upper portion of the front wall 16 are formed as a first housing component, and the remainder of the front wall 16 and the bottom wall 19 are formed as a second housing component to facilitate installation of the shutter assembly 10. A shutter support member 20 is mounted for rotation within the shutter housing. The support member 20 includes a generally cylindrical central shaft 22 and a plurality of mounting members 24 fixed to the shaft 22.

The upper end of a rolling shutter curtain 30 is coupled to one or more of the mounting members 24. The shutter curtain 30 is composed of a plurality of individual, elongate slats 32. One example of a configuration of slats 32 is illustrated in FIG. 2. The slats 32, each of which may have a curved cross-section to facilitate wrapping around the shutter support member 20, and may be composed of steel, aluminum, or other appropriate material, are interconnected by a plurality of hinges 34, each of which joins together a pair of adjacent slats 32. Each of the slats 32 includes an upward projection 35 extending longitudinally along the upper edge of the slat 32 and having a rearwardly and downwardly extending hook 36 at the top. Each of the slats 32 further includes a downward facing generally U-shaped recess 37 extending longitudinally along the lower edge of the slat 32 and having a forward horizontal projection 38 formed on one edge of the recess 37 and extending partially across the open end of the recess 37. The hook 36 of a lower slat 32 and the recess 37 and projection 38 of an upper slat 32 interlock to form each hinge 34. The recess 37 may further be formed with a semi-circular portion 39 forming an integral screw boss for engaging a retention member that will in turn engage the corresponding side track of the shutter assembly 10 to retain the shutter curtain 30 within the side tracks. This shutter slat configuration is illustrated and described more fully in U.S. Pat. No. 7,357,171 (hereinafter "the Miller '171 patent"), which is expressly incorporated by reference herein for all purposes. Another example of a shutter assembly with end retention is shown in the Miller '224 patent which is expressly incorporated by reference herein for all purposes. Other configurations of slats 32 and interconnecting hinges 34, such as the configuration of the Solomon shutters, are well known in the art and are contemplated by the inventor as having use with the present invention.

Referring back to FIG. 1, the ends of the slats 32 are disposed within a pair of shutter side tracks 40. The shutter assembly 10 may include a drive motor housing 42 at one of the end caps 14 containing a reversible drive motor, such as a tubular operator (not shown), connected to the rotatable shaft 22 to rotate the shaft 22 in either direction to raise and lower the shutter curtain 30. The motor housing 42 may also include a gear assembly (not shown) connected to the shaft 22 with a removable hand crank for manually raising and lowering the shutter curtain 30 in the event of a failure of the drive motor, such as during a power outage. When mounted to protect a window or other opening, the side tracks 40 of the shutter assembly 10 are positioned on either side of the opening and the shutter housing is positioned over the top of the opening. Alternatively, in some applications, the side tracks 40 and shutter housing are positioned within the opening. When the shutter curtain 30 is not in use, it is rolled up on the shutter support member 20 via the drive motor or, if necessary, the hand crank so that it is at least partially enclosed by the shutter housing. The hand crank may be connected at the lower front portion of the end cap 14 in which the gear assembly is disposed or, depending on the particular installation, may extend from a rear portion of the shutter assembly 10 through the structure surrounding the opening so that the shutter curtain 30 can be unrolled from inside the building. Using the drive motor or the hand crank, the shutter curtain 30 is rolled up into the shutter housing until a base slat 46 and its base plate 48 are disposed at the shutter housing.

The structure of one example of previously known side tracks 40 is illustrated in FIG. 3, which is a horizontal cross-section of one of the side tracks 40. Each side track 40 has a pair of side walls 56, 58, and an end wall 60. The side track 40 further includes a first pair of fins 62, 64 that extend inwardly from the side walls 56, 58, respectively, and define a first gap 66 that is wide enough to receive retention members (not shown) and engage the retention members to retain the shutter curtain 30 in a manner described more fully in the Miller '224 patent and in U.S. Pat. No. 6,095,225 (hereinafter "the Miller '225 patent") which is expressly incorporated by reference herein for all purposes. A third fin 68 and semi-circular wall 70 define a second gap 72 that is wide enough to receive an engagement member such as an arm extending outwardly from the base slat 46 of the shutter curtain 30 as will be described more fully below. A second pair of fins 74, 76 extends inwardly from the side wall 56 between the end wall 60 and semi-circular wall 70 and toward the other side wall 58.

Configured in this way, the side tracks 40 provide multiple channels. The fins 62, 64 and portions of the side walls 56, 58 define a first channel adapted to receive the slats 32, 46 when the shutter curtain 30 is unrolled. The fins 62, 64, 68 and a portion of the semi-circular wall 70 define a second channel adapted to receive the retention members as illustrated and described in the Miller '224 and '225 patents. The fin 68 and the remainder of the semi-circular wall 70 define a third channel adapted to receive the engagement member or arm of the base slat 46 and an adjustable throw member 78 as discussed more thoroughly below. Finally, the end wall 60, portions of the side walls 56, 58, and the semi-circular wall 70 define a fourth channel that receives a nipple 80 extending downwardly from one of the end caps 14 when the end cap 14 is attached to the side track 40, with the fins 74, 76 engaging the nipple 80 to prevent movement within the fourth channel. The fins 68, the semi-circular wall 70, and portions of the side walls 56, 58 extend upwardly partially into the shutter housing as will be discussed more fully below.

Figure 4:
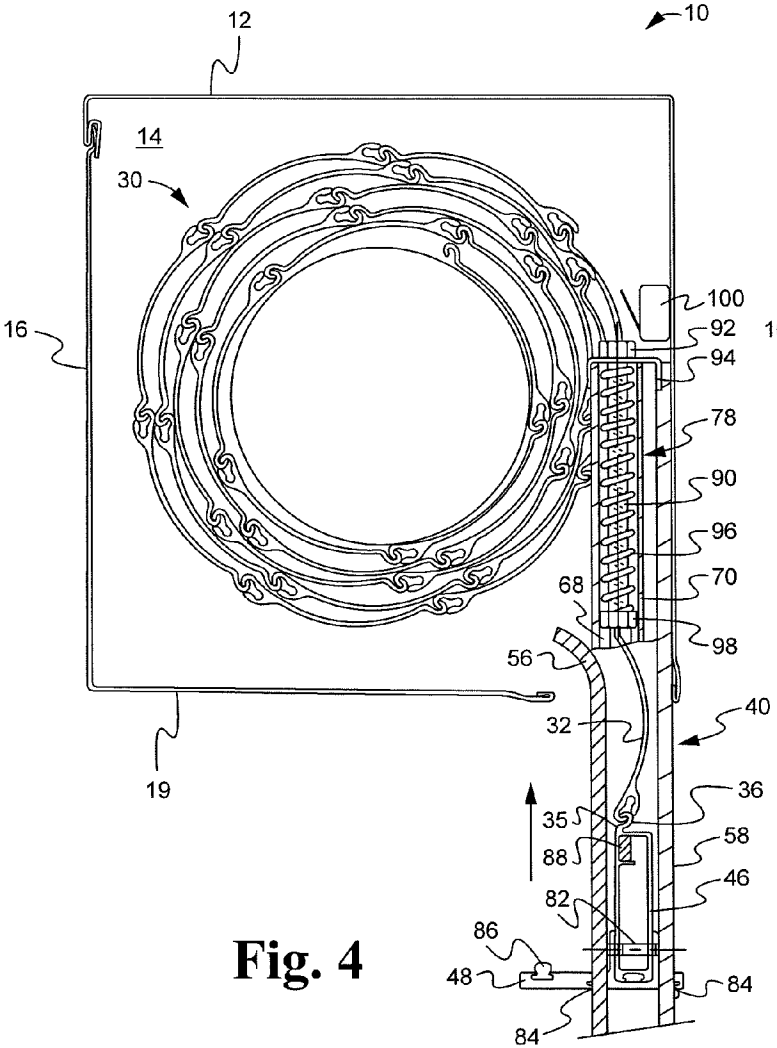
FIG. 4 is a side view of the upper portion of the shutter assembly of FIG. 1 with the lower portion of the side track shown in cross-section through line 4L-4L of FIG. 1, and with the upper portion of the side track shown in cross-section through line 4U-4U of FIG. 1.

A retention and triggering mechanism according to the present disclosure may utilize engagement members or arms extending from the base slat 46 to engage an upwardly extending portion of the third channel in the shutter housing and to engage the adjustable throw member 78 disposed within one of the side tracks to actuate a limit switch within the shutter housing. FIG. 4 is a side view of the upper portion of the shutter assembly 10 with the end cap 14 and shutter support member 20 removed for clarity. The lower portion of the side track 40 is shown in cross-section through line 4L-4L of FIG. 3 to show the features of the base slat 46, and the upper portion of the side track 40 within the shutter housing is shown in cross-section through line 4U-4U of FIG. 3 to show the retaining portion of the side track 40 and the adjustable throw member 78. The base slat 46 may have a generally rectangular cross-section for strength and to prevent the base slat 46 from twisting within the side track 40. The base slat 46 includes a upward projection 35 and hook 36 similar to those of the slats 32 extending longitudinally along the upper edge of the base slat 46 so that the hook 36 may interlock with the recess 37 of the bottommost slat 32 of the shutter curtain 30.

The base slat 46 may further include base plate 48 disposed at a bottom edge of the base slat 46. The base plate 48 extends outwardly from the front of the base slat 46 by a distance that will allow the base plate 48 to cover the opening between the base slat 46 and the edge of the bottom side 19 of the shutter housing when the shutter curtain 30 is rolled up. The base plate 48 also has a width dimensioned to essentially span the distance between the inside edges of the side tracks 40. As illustrated, the base plate 48 may be attached to the base slat 46 via bolts, rivets or any other appropriate fasteners 82. Alternatively, the base plate 48 may be welded or otherwise securely affixed to the bottom of the base slat 46, or the base slat 46 and base plate 48 may be integrally formed as a single unitary component. The base slat 48 may further include one or more gaskets 84 attached to and extending along the bottom surface of the base plate 48 to form a seal with the surface of the opening when the shutter curtain 30 is closed. Similarly, one or more gaskets 86 may extend along the upper surface of the base plate to form a seal with the bottom wall 19 of the shutter housing when the shutter curtain 30 is fully rolled up.

Figure 5:
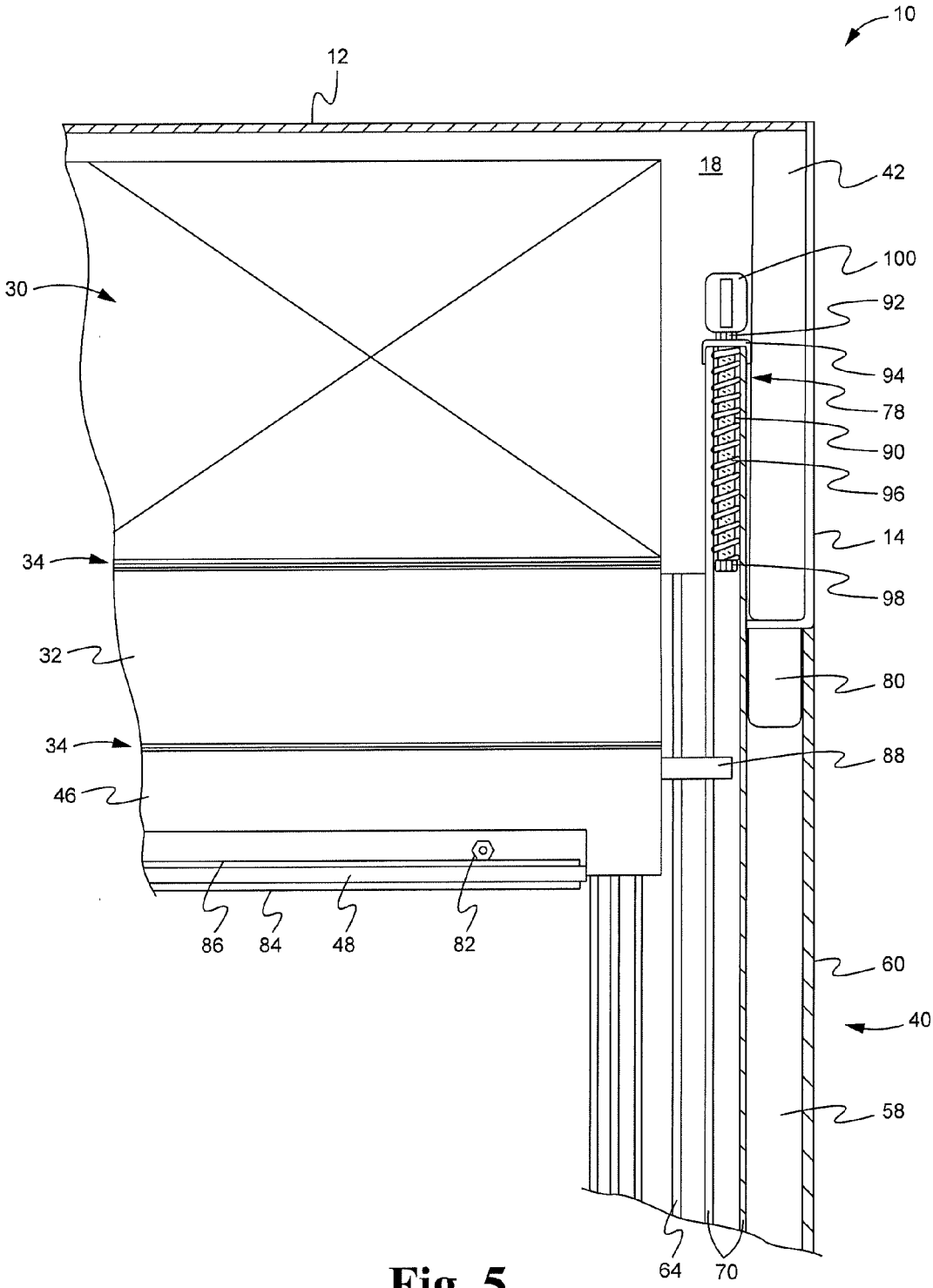
FIG. 5 is a front view of the upper right portion of the shutter assembly of FIG. 1 with the front wall and bottom wall removed and the shutter support member not shown for clarity, and with the side track shown in cross-section taken along line 5-5 of FIG. 3.

At the upper edge of the base slat 46, engagement members such as guide arms 88 extend outwardly from either end of the base slat 46. FIG. 5 illustrates the upper right portion of the shutter assembly 10 with the front wall 16 and bottom wall 19 removed, and the rolled up portion of the shutter curtain 30 being shown schematically. Additionally, for further clarity, the shutter supporter member 20 is not shown, and the side track 40 is shown in cross-section reflecting a section line passing through the end wall 60 and wall 70. The guide arms 88 extend far enough from the ends of the base slat 46 to pass through the first gap 66 and the second gap 72 and into the channel defined by the fin 68 and wall 70. The guide arms 88 may be connected to the base slat 46 by any appropriate mechanism, and may be formed from a material that is sufficiently strong so as not to bend when the guide arms 88 engage or are engaged by the side tracks 40 and the adjustable throw member 78.

The end wall 60 and portions of the side walls 56, 58 extend to the necessary height for insertion of the nipple 80 of the end cap 14 to position the shutter housing above or at the top of the opening. The portions of the side walls 56, 58 on the side inward of the fin 68 and wall 70 may extend upwardly into the interior of the shutter housing by a distance that allows the shutter curtain to roll up onto the shutter support member 20 without interference, but sufficient to act as a guide for directing the slats 32, 46 back into the side tracks when the shutter curtain is unrolled. The guidance function may be further promoted by bending the upper portion of the side wall 56 forward to open the top of the first and second channels of the side track 40 as shown in the side view of FIG. 4.

The remaining portion of the side tracks 40 defined by the fin 68, wall 70 and corresponding portions of the side walls 56, 58 extend upwardly farther into the shutter housing. As shown in FIGS. 4 and 5, this upwardly extending portion of the side tracks 40 runs along the inside surface of the rear wall 18 and inward of the end cap 14 and drive motor housing 42. The adjustable throw member 78 is disposed within this portion of the side track 40. In the illustrated embodiment, the adjustable throw member 78 is implemented in the form of a bolt 90 and nut 92 that may be held in place within the side track by a bracket or cap 94 or other securement mechanism that will hold the bolt 90 in the normal position shown in FIGS. 4 and 5 while allowing the bolt 90 to slide upwardly when engaged by the arm 88 of the base slat 46 as discussed further below. The adjustable throw member 78 may further include a biasing member such as spring 96 having one end engaging the head 98 of the bolt 90 and the other end secure relative to the side track 40 such as by the cap 94 or other attachment mechanism such that the spring 96 biases the bolt 90 toward the normal position and, if necessary, provides a force on the arm 88 to ensure that the base slat 46 moves downward in the side tracks 40 when the shutter curtain 30 is unrolled.

Figure 6:
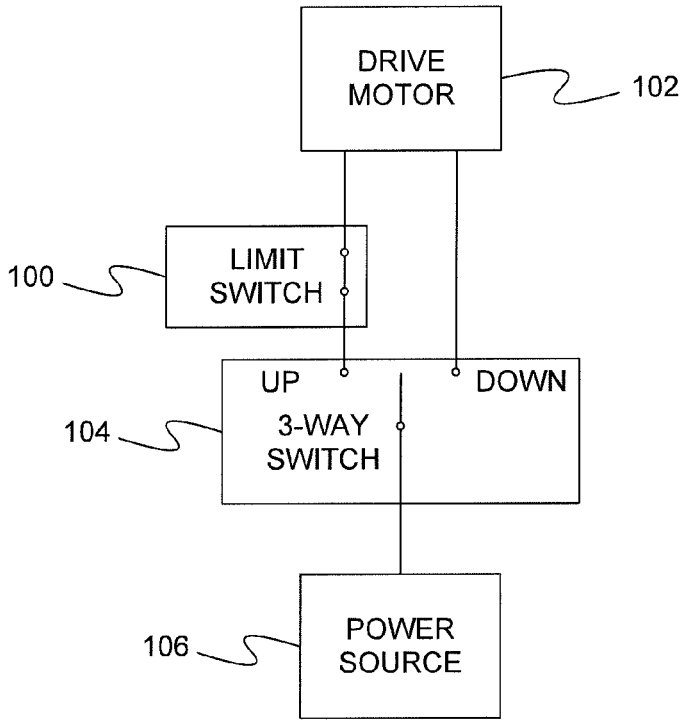
FIG. 6 is a block diagram of the electrical components of the protective shutter assembly of FIG. 1.

To ensure that the drive motor turns off when the shutter curtain 30 rolls up to the desired position, a limit switch 100 is mounted in the shutter housing and operatively connected to the drive motor. FIG. 6 is a block diagram of one embodiment of the electrical components of the rolling shutter assembly 10. A drive motor 102 may be disposed within the motor housing 42 and connected to the shutter support member 20. In order to operate the drive motor 102 in either direction to raise and lower the shutter curtain 30, a three-way switch 104 is operatively connected to the drive motor 102 and the limit switch 100. Power for the drive motor 102 may be provided by a power source 106, such as by a tie in to the building's electrical service. The three-way switch 104 may be any appropriate switch having a first position that will cause the drive motor 102 to rotate in the direction to roll up the shutter curtain 30, a second position that will cause the drive motor 102 to rotate in the opposite direction, and a third position wherein the drive motor 102 is turned off. A single pole, center off switch is one example of an appropriate three-way switch 104.

To control the position of the shutter curtain 30 as it is rolled up by the drive motor 102, the limit switch 100 is positioned in the path between the drive motor 102 and the lead of the three-way switch 104 that will cause the drive motor 102 to wind the shutter curtain 30. The limit switch 100 may be any appropriate electro-mechanical or electrical switch that is normally closed, or "push to break," such that the limit switch 100 breaks contact and opens when the button or other mechanical actuation device is pressed, and reestablished contact to close the limit switch 100 when released. The drive motor 102 is illustrated as being directly connected to the lead of the three-way switch 104 that will cause the drive motor 102 to unwind the shutter curtain 30, but those skilled in the art will understand that switches or other types of control or safety mechanisms may be installed along this path as well.

Returning to FIGS. 4 and 5, the shutter curtain 30 is partially unrolled so that the base slat 46 is disposed within the first channel of the side tracks 40. In this position, the arm 88 of the base slat 46 is disengaged from the adjustable throw member 78, and the limit switch 100 is in the normal closed position. When the three-way switch 104 is moved to the "UP" position of FIG. 6, and with the limit switch 100 closed, the drive motor 102 is actuated to wind the shutter curtain 30 onto the shutter support member 20. As the shutter curtain 30 winds, the base slat 46 eventually moves upwardly into the shutter housing. The portions of the side walls 56, 58 of the side tracks 40 terminate to allow the slats 32 to roll up onto the shutter support member 20. However, the arms 88 of the base slat 46 are engaged by the fins 68 and walls 70 of the side tracks 40 such that the base slat 46 continues to move vertically along the side tracks 40.

Figure 7:
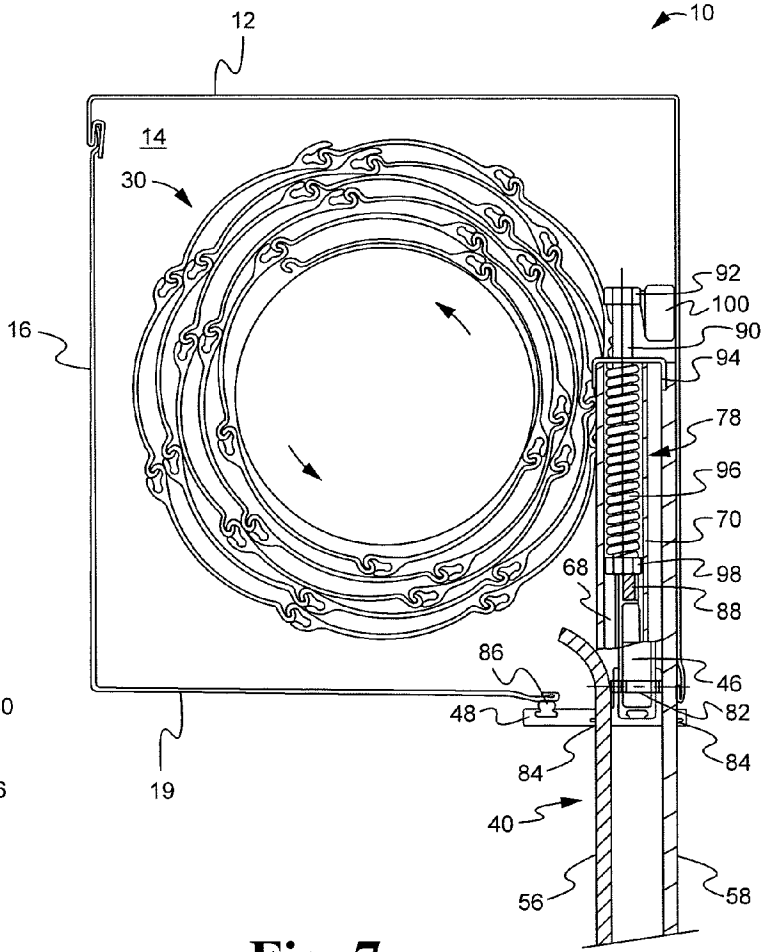
FIG. 7 is the side view of FIG. 4 with the shutter curtain rolled to the upper limit position.
Figure 8:
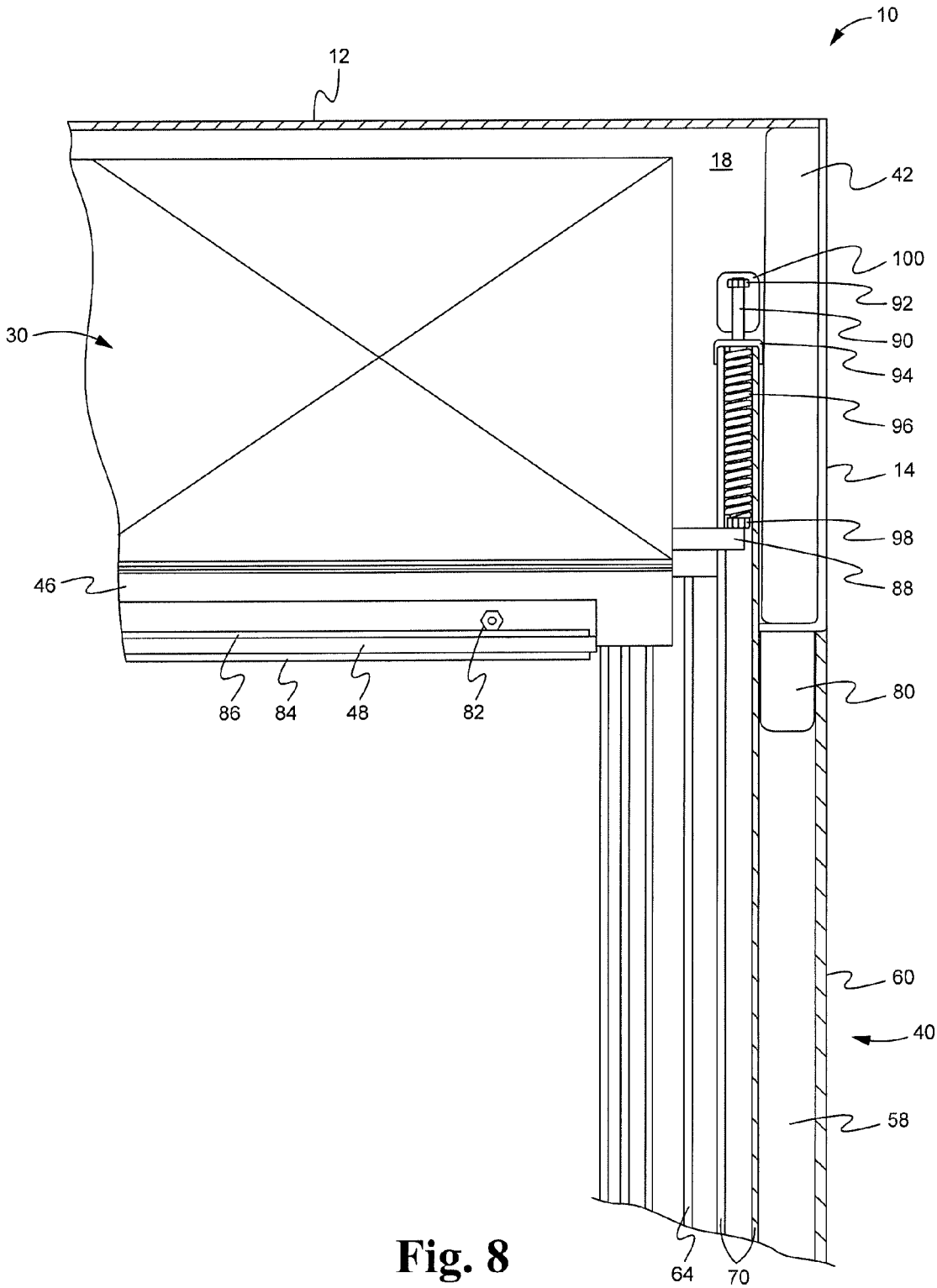
FIG. 8 is the front view of FIG. 5 with the shutter curtain rolled to the position of FIG. 7.

As the base slat 46 continues to move vertically, the arm 88 engages the head 98 of the bolt 90, forcing the bolt 90 upwardly against the force of the spring 96 as the spring 96 compresses between the head 98 and the cap 94. The nut 92 moves upwardly with the bolt 90 and ultimately engages the actuator of the limit switch 100. When the shutter curtain 30 is rolled up to its limit position as shown in FIGS. 7 and 8, the limit switch 100 is fully actuated to open the limit switch 100 and to turn off the drive motor 102 even if the three-way switch 104 remains in the "UP" position. The limit switch 100 may be positioned and the adjustable throw member 78 may be dimensioned so that the drive motor 102 turns off when the base slat 46 is almost completely disposed within the shutter housing. In this position, the gasket 86 on the upper surface of the base plate 48 may engage the bottom wall 19 of the shutter housing to cover the opening and present a clean, finished appearance. The upper limit for the shutter curtain 30 may be adjusted by moving the limit switch 100 up or down, or by loosening or tightening the nut 92 on the bolt 90 to change the distance between the nut 92 and the head 98 of the bolt 90. Of course, those skilled in the art will appreciate that other configurations of throw members 78 and limit switches 100 may be implemented such that drive motor 102 may be shut off when the base slat 46 reaches a predetermined position, and such variations are contemplated by the inventor as having use in rolling shutter assemblies in accordance with the present disclosure.

To close the shutter curtain, the three-way switch 104 is moved to the "DOWN" position. Because the limit switch 100 is not in the path that controls the unwinding of the shutter curtain 30, the drive motor 102 is actuated to rotate in the direction to unroll the shutter curtain 30 from the shutter support member 20. Where the spring 96 or other biasing mechanism is provided, such as alternative spring arrangements or the addition of weights within the base slat 46, the biasing force presses downwardly on the base slat 46 to ensure that the base slat 46 moves downward into the side track 40 for proper deployment of the shutter curtain 30 as it is unrolled. The shutter curtain 30 may be unrolled to the desired position, at which time the three-way switch 104 may be moved to the "OFF" position to turn off the drive motor 102.

FIGS. 4-8 illustrate an implementation of an electro-mechanical limit switch 100 having a spring biased arm mounted in the shutter housing for engagement by the throw assembly. However, the use of other types of switches detecting the disposition of the base slat 46 proximate the shutter housing is contemplated by the inventor. For example, a pneumatic switch may be implemented having an input that causes the switch to open when pressure at the input is increased due to engagement by the throw assembly or other component, such as the guide arm 88 of the base slat 46. Still further, an optical switch may be implemented and positioned to detect a component of the rolling shutter assembly 10 arriving at a predetermined location when the shutter curtain 30 is fully rolled up and cause the motor to stop. Consequently, the electro-mechanical limit switch 100 of FIGS. 4-8 may be replaced by an optical switch having an eye positioned to detect when the nut 92 arrives at the position shown in FIGS. 7 and 8 and shut off the motor.

Figure 9:
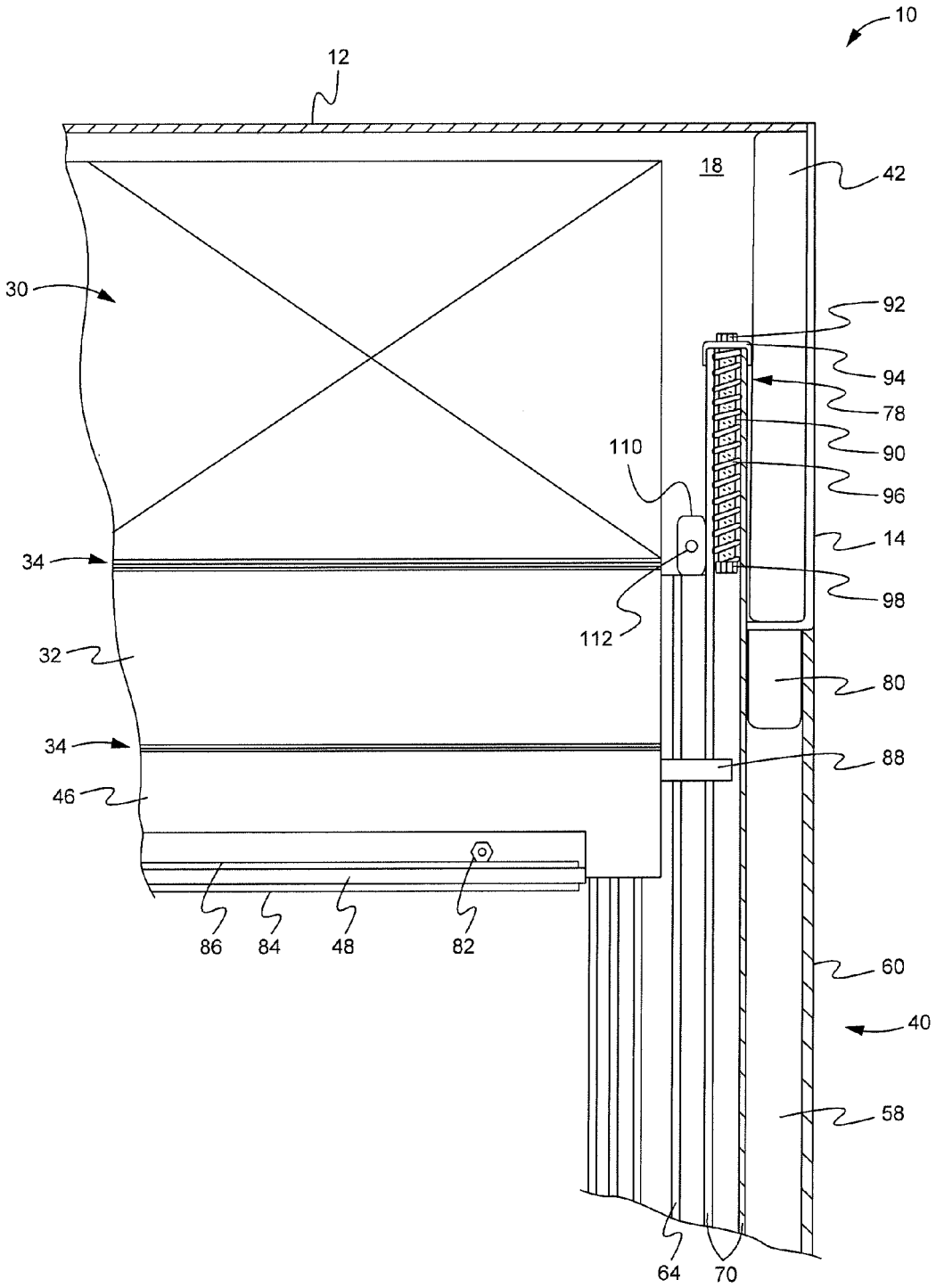
FIG. 9 is the front view of FIG. 5 with a limit switch positioned for actuation by the guide arm of the base slat.
Figure 10:
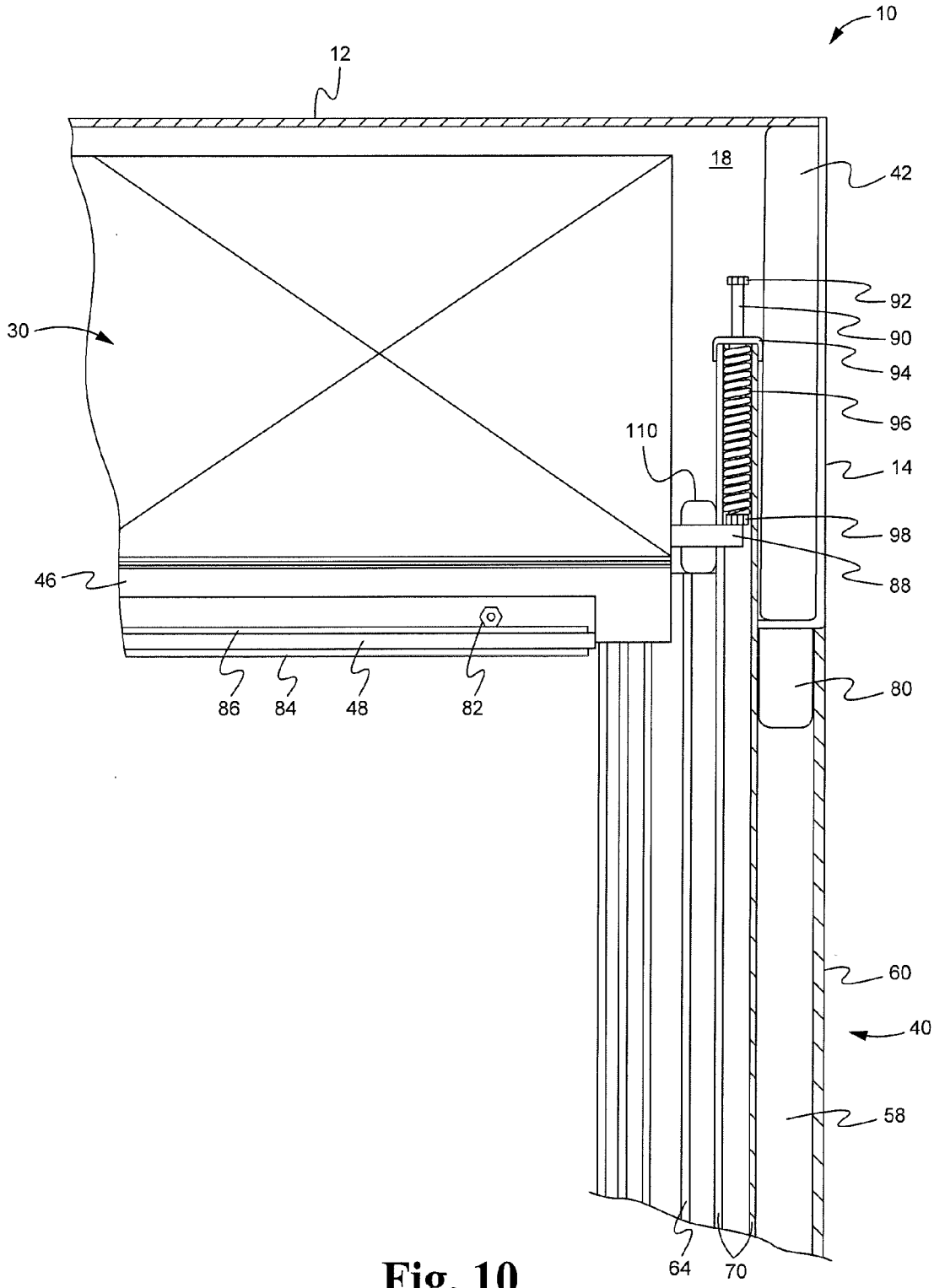
FIG. 10 is the front view of FIG. 9 with the shutter curtain rolled to the upper limit position.

Alternatively, the optical or other limit switch may be positioned to detect the arrival of the guide bar 88 at a predetermined position within the shutter housing. Referring to FIG. 9, the rolling shutter assembly 10 is modified to replace the electro-mechanical limit switch 100 of FIGS. 4-8 with an optical limit switch 110 mounted within the shutter housing proximate the side track 40. The optical limit switch 110 may be operatively connected to the drive motor 102, three-way switch 104 and power source 106 is a similar manner as described above with respect to FIG. 6. The optical limit switch 110 may have an eye 112 positioned at the location of the guide arm 88 when the base slat 46 reaches the desired location within the shutter housing. As the shutter curtain 30 is rolled up onto the shutter support member 20, the guide arm 88 may engage the head 98 and compress the spring 96 to create the downward biasing force that will ensure that the base slat 46 and shutter curtain 30 properly unroll into the side tracks 40. When the base slat 46 arrives at the position shown in FIG. 10, the eye 112 of the optical limit switch 110 may detect the guide arm 88, and cause the optical limit switch 110 to open and thereby stop the drive motor 102 from rolling the shutter curtain 30 further. When the shutter curtain 30 is later unrolled, the guide arm 88 moves out of the position proximate the eye 112, and the optical limit switch 110 may then close so that the drive motor 102 will again be able to operate to roll up the shutter curtain 30.

In the embodiments discussed above, the limit switches in their various forms may be mounted to the housing walls during installation and subsequently connected to the drive motor 102 as shown in FIG. 6. Such an arrangement may be satisfactory in many implementations of the rolling shutter assembly 10. However, installation may be further simplified by mounting a limit switch in the end cap 14 along with the drive motor housing 42. This may allow the limit switch to be pre-installed and pre-wired within the end cap 14 at the factory, and the installers need only assembly the end caps 14 and walls 12, 16, 18, 19 without having to wire the electrical components in the field. With the limit switch disposed within the end cap 14, the end cap 14, base slat 46 and shutter housing may be reconfigured to allow actuation of the limit switch when the base slat 46 arrives at the shutter housing.

Figure 11:
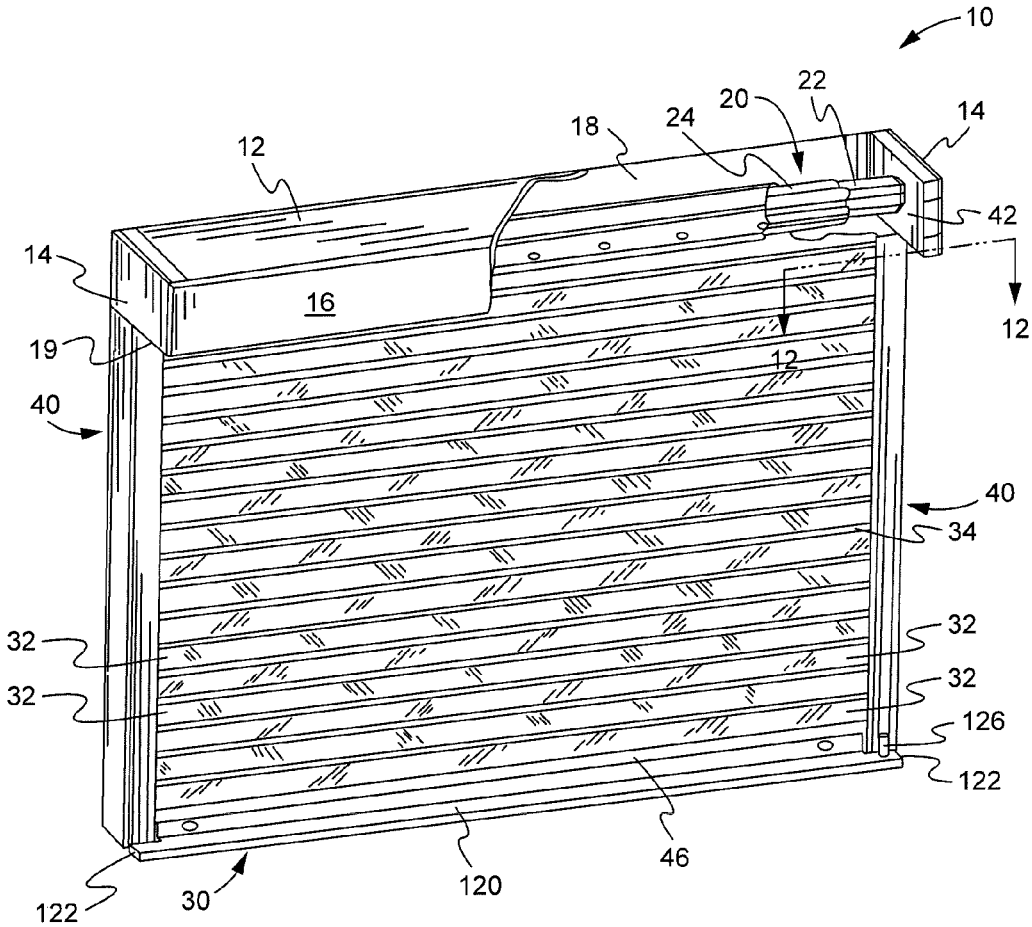
FIG. 11 is a perspective view of an alternative embodiment of a rolling shutter assembly that can implement the present invention.
Figure 12:
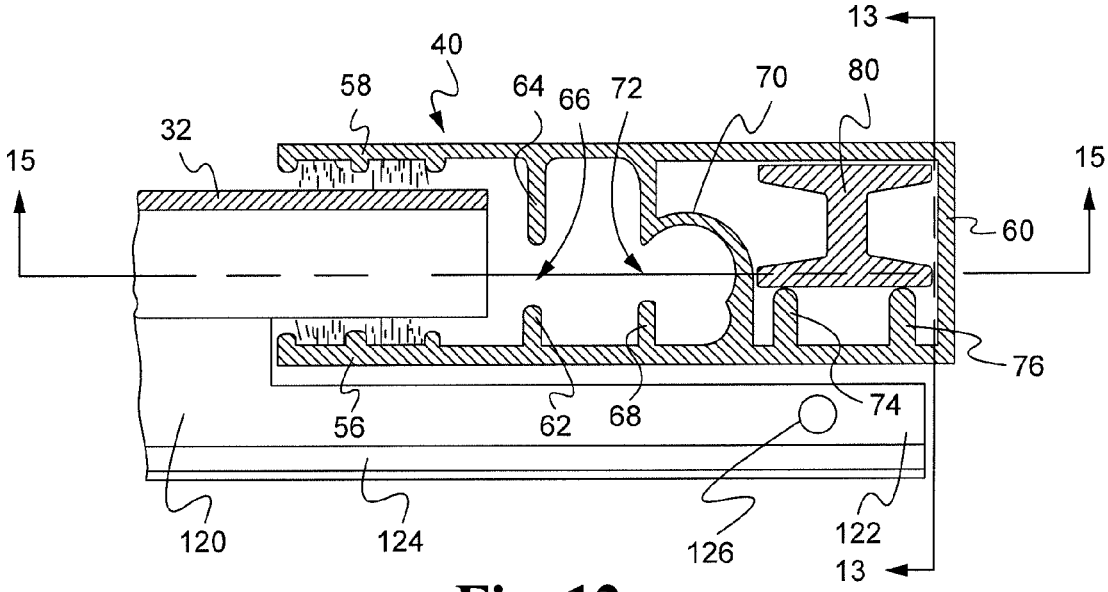
FIG. 12 is a cross-sectional view of a portion of the shutter assembly of FIG. 11 taken along line 12-12 and showing a base plate with a base plate extension in accordance with an alternative embodiment of the present disclosure.

FIGS. 11 and 12 illustrate one embodiment of the shutter assembly 10 wherein a base plate 120 may have base plate extensions 122 and gasket 124 extending outwardly across the front of the side tracks 40 with base plate extensions 122 terminating proximate the end walls 60 and under the end caps 14. At the outer portion of the base plate extension 122 disposed under the end cap 14 having a limit switch disposed therein, the base plate extension 122 may have a plunger 126 mounted thereon configured to actuate the limit switch when the base plate 120 is proximate the bottom of the shutter housing as will be described more fully below. The plunger 126 may be a separate component mounted to a top surface of the base plate 120, or may be integrally formed with the base plate 120 as a single unitary component.

Figure 14:
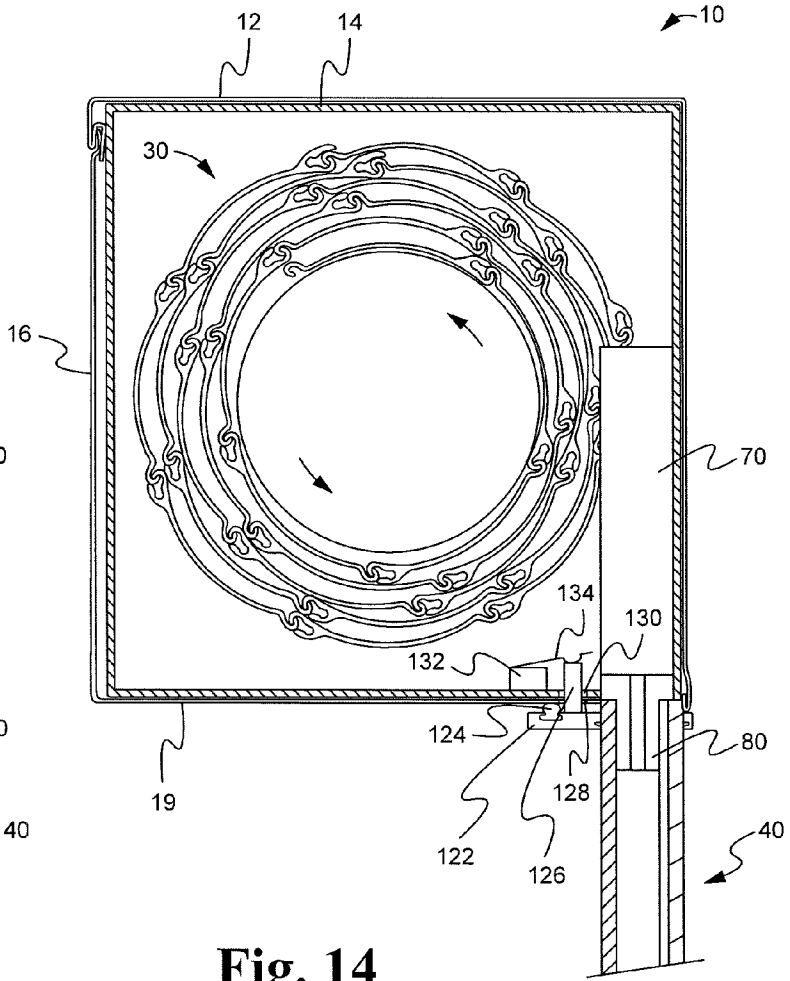
FIG. 14 is the side view of FIG. 13 with the shutter curtain rolled up to the upper limit position.
Figure 13:
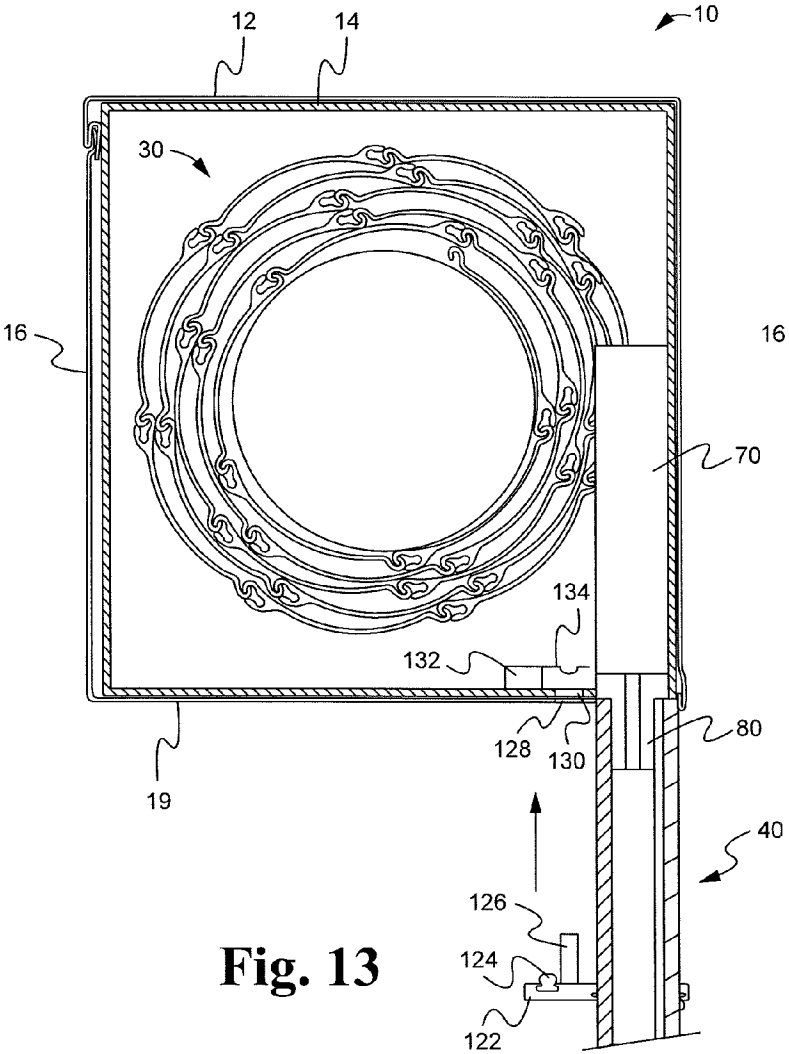
FIG. 13 is a side view of the upper portion of the shutter assembly of FIG. 11 with the side track shown in cross-section through line 13-13 of FIG. 12, and with the end cap shown in cross-section with the end wall, drive motor and shutter support member removed for clarity.

Referring to FIG. 13, the base plate extension 122 is shown approaching the bottom wall 19 of the shutter housing and the end cap 14. The bottom wall 19 may have an opening 128 and a bottom wall of the end cap 14 may have a corresponding opening 130 aligned with the opening 128 and disposed above the plunger 126. An electro-mechanical limit switch 132 may be mounted within the end cap 14 proximate the opening 130, and may have an actuator arm 134 extending there from and overlying the openings 128, 130. The limit switch 132 may be operatively connected to the drive motor 102 as illustrated in FIG. 6 and described in the accompanying text. As the base slat 46 and base plate 120 approach the bottom of the shutter housing, the plunger 126 is aligned with the openings 128, 130 and able to pass through the openings 128, 130 and engage the actuator arm 134 of the limit switch 132. As shown in FIG. 14, the engagement of the plunger 126 may cause the actuator arm 134 to deflect upwardly and open the limit switch 132, thereby shutting off the drive motor 102. The limit switch 132 and plunger 126 may be dimensioned so that the gasket 124 engages the bottom wall 19 and forms a seal to close the opening of the shutter housing through which the shutter curtain 30 is dispatched and the openings 128, 130. Moreover, a majority of the force of engagement between the shutter housing and the base plate 120 may be taken up by the end caps 14 instead of the bottom wall 19. Such engagement by the end caps 14 may reduce distortion of the shutter housing when the shutter curtain is rolled up, as the shutter housing in many installations is fabricated from relatively weak sheet metal that may easily deflect when a load is applied.

In alternative embodiments, the plunger 126 may be a component of the limit switch 132. For example, the plunger 126 may be connected to or formed with the actuator arm 134 and extend downwardly through the openings 128, 130 with an end disposed external to the shutter housing. As the base slat 46 approaches the shutter housing, the top surface of the base plate 120 may engage the end of the plunger 126 to push the actuator arm 134 upwardly and open the limit switch 132.

Figure 15:
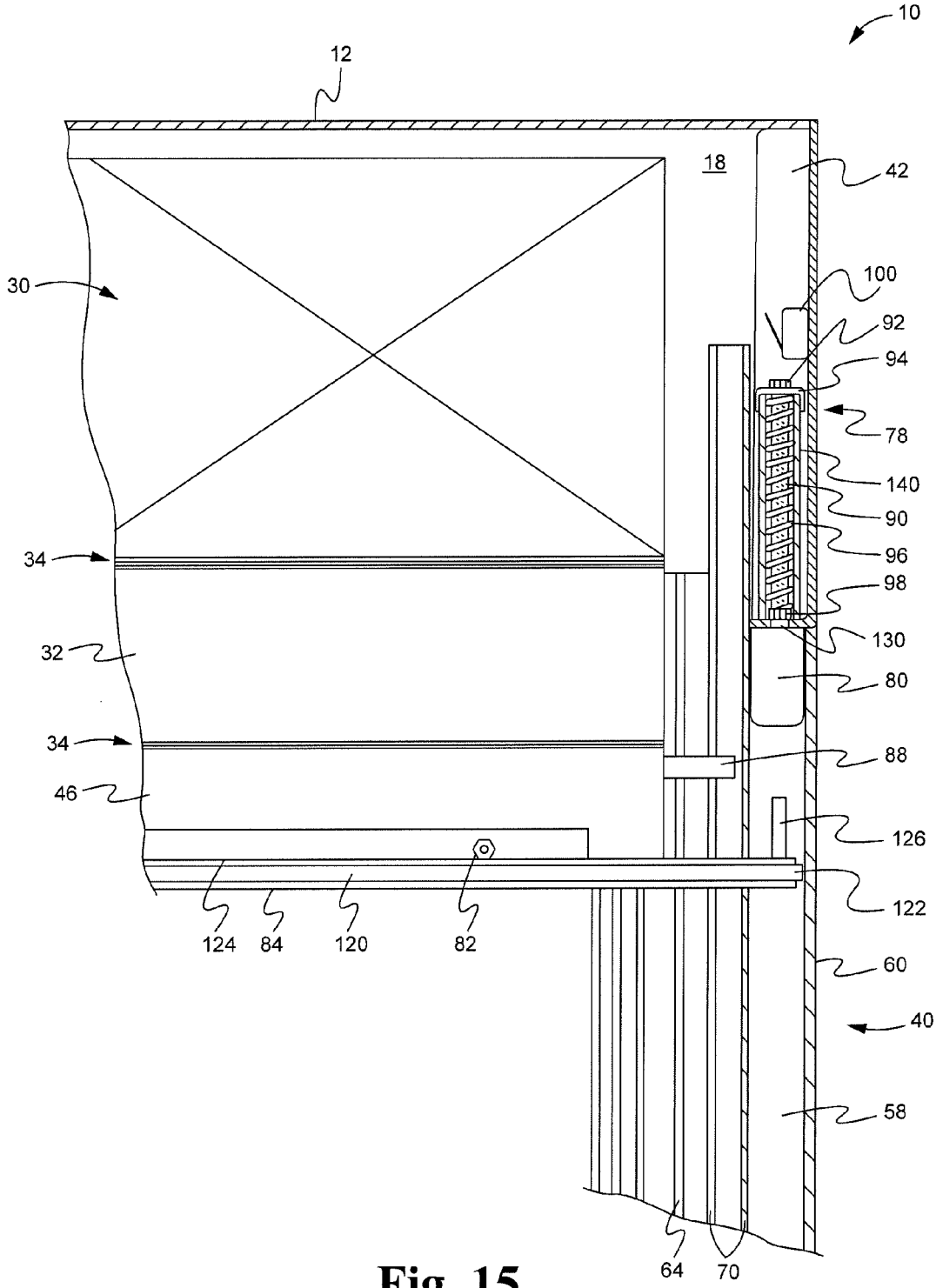
FIG. 15 is a front view of the upper right portion of an embodiment of the shutter assembly of FIG. 11 with the front wall and bottom wall removed and the shutter support member not shown for clarity, and with the side track shown in cross-section taken along line 15-15 of FIG. 12.
Figure 16:
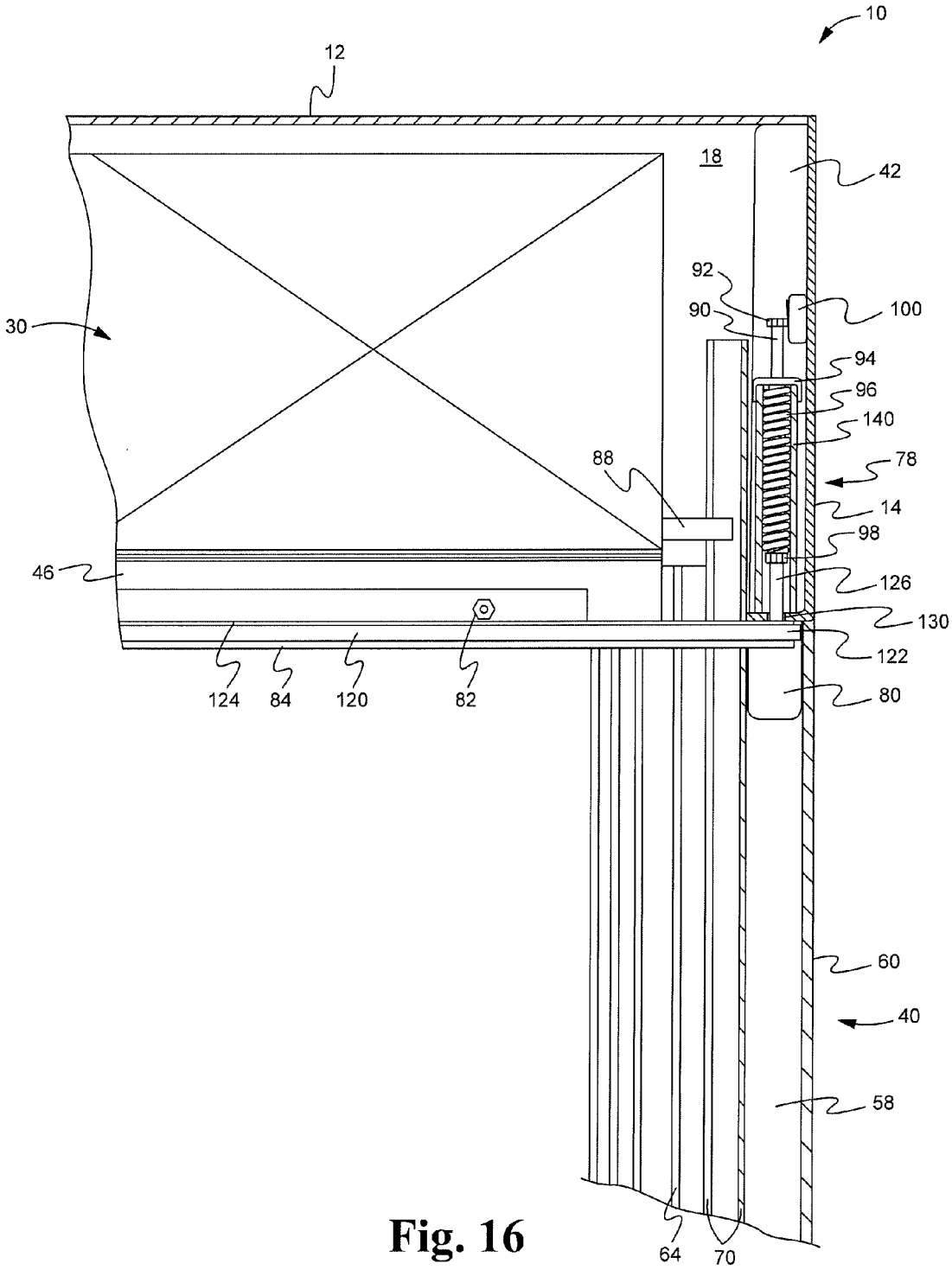
FIG. 16 is the front view of FIG. 15 with the shutter curtain rolled up to the upper limit position.

Although not shown from the side views of FIGS. 13 and 14, the bolt 90 and spring 96 may be disposed within the side tracks 40 as shown in the previous embodiments such that the guide arms 88 of the base slat 46 engages the head 98, creating the downward force to ensure that the shutter curtain 30 unrolls into the side tracks 40. Alternatively, the components of the adjustable throw member 78 may be moved into the end cap 14 along with the limit switch to provide the triggering of the limit switch and the spring force guiding the base slat 46 into the side tracks 40. FIGS. 15 and 16 show an embodiment implementing the adjustable throw member 78 into the end cap 14. Referring to FIG. 15, the adjustable throw member 78 may be placed in the end cap 14 within a retention sleeve 140 and with the head of the bolt 90 aligned above the end cap opening 130. The limit switch 100 may also be moved into the end cap 14 with the actuator of the limit switch 100 positioned above the nut 92. As discussed above, the plunger 126 may be aligned with the end cap opening 130 so that the plunger 126 enters the end cap 14 through the opening 130 as the base slat 46 and base plate 120 approach the shutter housing. As the base slat 46 continues to move vertically, the plunger 126 engages the head 98 of the bolt 90, forcing the bolt 90 upwardly against the force of the spring 96 as the spring 96 compresses between the head 98 and the cap 94. The nut 92 moves upwardly with the bolt 90 and ultimately engages the actuator of the limit switch 100.

When the shutter curtain 30 is rolled up to its limit position as shown in FIG. 16, the limit switch 100 is fully actuated to open the limit switch 100 and to turn off the drive motor 102. The limit switch 100 may be positioned and the adjustable throw member 78 may be dimensioned so that the drive motor 102 turns off when the base plate 120 is proximate the bottom wall 19 of the shutter housing with the gasket 124 engaging the bottom wall 19 to cover the opening and present a clean, finished appearance. At the same time, the spring 96 provides a downward biasing force ensuring that the base slat 46 drops down into the side tracks 40 when the shutter curtain 30 is unrolled. A biasing mechanism may be positioned in the opposite end cap 14 if necessary to ensure balanced forces on either end of the base slat 46, though the limit switch 100 need only be placed in one of the end caps 14.

Figure 17:
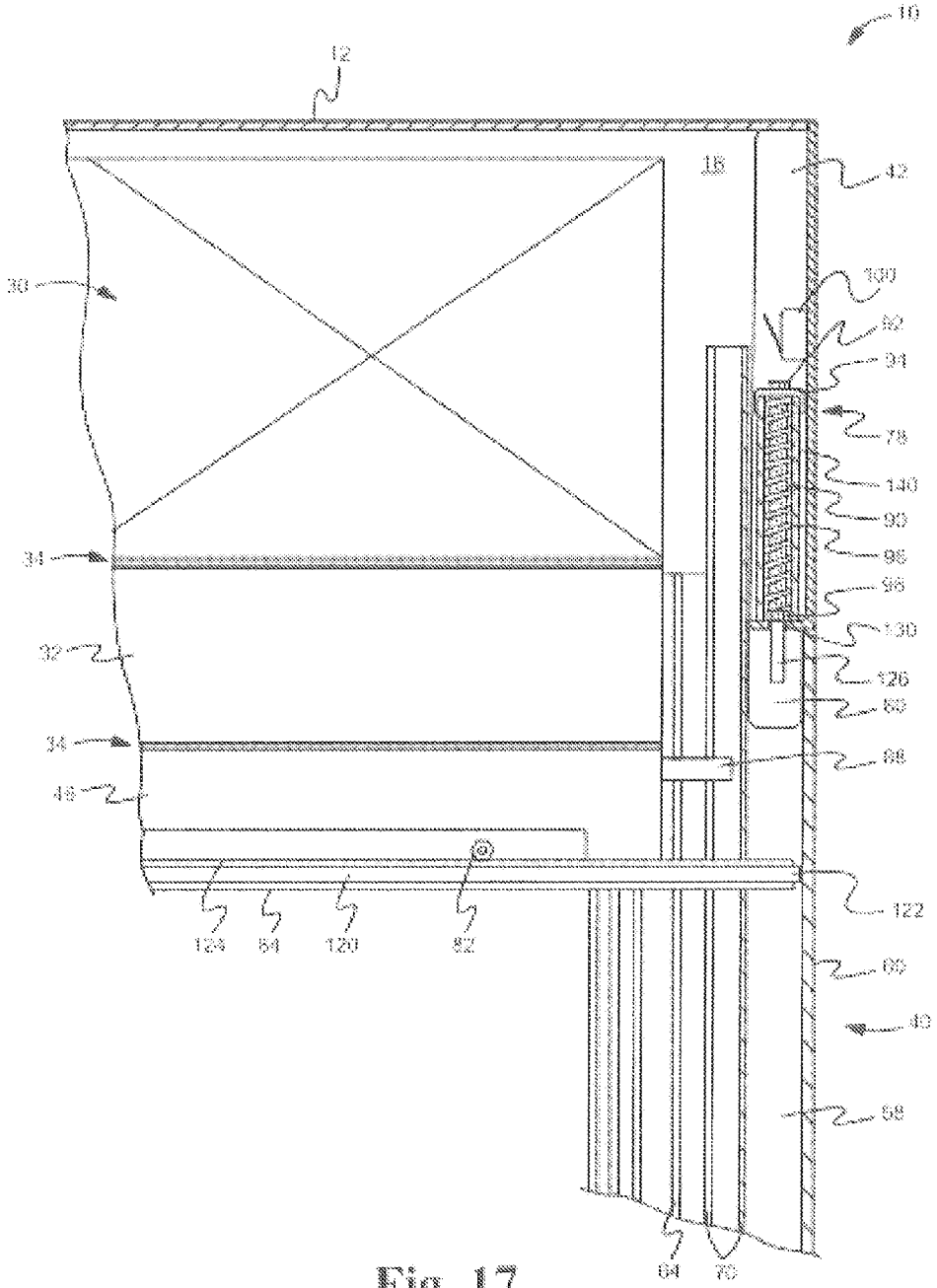
FIG. 17 is the front view of FIG. 15 with the plunger disposed on the throw member and extending downwardly from of the shutter housing.

As discussed above, other configurations of throw members 78 and limit switches 100 may be implemented such that drive motor 102 may be shut off when the base slat 46 reaches a predetermined position, and such variations are contemplated by the inventor as having use in rolling shutter assemblies in accordance with the present disclosure. For example, FIG. 17 illustrates an alternative embodiment wherein the plunger 126 may be disposed on the throw member 78 and extend downwardly through the opening 130 and extend below the bottom wall 19 of the shutter housing. The base plate 120 may engage the plunger 126 as the base slat 46 enters the shutter housing to actuate the limit switch 100. In a similar manner with other embodiments discussed herein, a portion of a triggering mechanism for the limit switches may extend out of the shutter housing for engagement by the base slat 46 to stop the drive motor.

Figure 18:
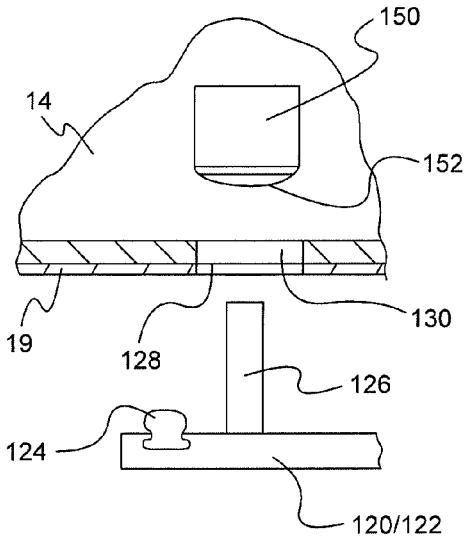
FIG. 18 is a side view of a portion of the end cap and bottom wall of an embodiment of the shutter assembly of FIG. 11 implementing a pressure actuated limit switch and resilient plunger.
Figure 19:
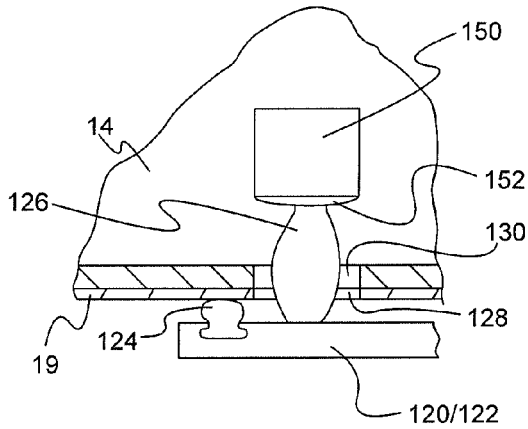
FIG. 19 is the side view of FIG. 18 with the shutter curtain rolled up to the upper limit position.

In further alternate embodiments, a biasing force on the base slat 46 may be provided through the limit switch actuation mechanism in a manner that eliminates the need for an additional spring mechanism within the end cap 14. In one embodiment illustrated in FIGS. 18 and 19, the plunger 126 may be fabricated from a resilient material that may be compressed to create a spring force. Referring to FIG. 18, the base plate 120, the base plate extension 122 and the plunger 126 may be positioned relative to the openings 128, 130 as discussed above in relation to FIGS. 13 and 14. In this embodiment, a limit switch in the form of a pressure switch 150 may be implemented and mounted within the end cap 14 with a pressure actuator 152 facing the openings 128, 130 and plunger 126. As the plunger 126 enters the end cap 14 through the openings 128, 130, the upper end of the plunger 126 engages the pressure actuator 152 of the pressure switch 150. As base plate 120 is raised further, the resilient plunger 126 may compress and the pressure applied to the pressure actuator 152 may increase until the predetermined actuation pressure for the pressure switch 150 is reached. The plunger 126 may be configured and the pressure switch 150 may be selected and positioned so that the drive motor 102 is shut off when the base plate 120 reaches the upper limit position shown in FIG. 8 with the gasket 124 engaging the bottom wall 19 of the shutter housing.

Figure 20:
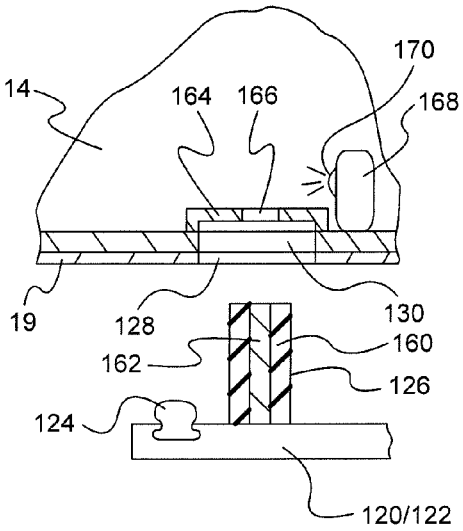
FIG. 20 is a side view of a portion of the end cap and bottom wall of an embodiment of the shutter assembly of FIG. 11 implementing an optical limit switch and resilient plunger.
Figure 21:
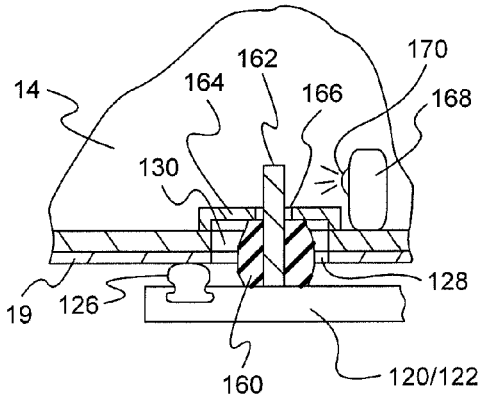
FIG. 21 is the side view of FIG. 20 with the shutter curtain rolled up to the upper limit position

FIGS. 20 and 21 show another embodiment of the plunger 126 having resiliency to provide the downward biasing force on the base slat 46 when the shutter curtain 30 is rolled up into the shutter housing. As shown in FIG. 20, the plunger 126 may have a multi-part construction including an outer resilient annular sleeve 160 and an inner finger 162. The end cap 14 may be configured with an interior bracket 164 proximate the end cap opening 130 and having a bracket opening 166 having an inner diameter that is greater than an outer diameter of the finger 162 and less than an outer diameter of the annular sleeve 160. In this embodiment, an optical limit switch 168 having an eye 170 may be implemented, though other types of limit switches may be used. As the base slat 48 approaches the shutter housing, the plunger 126 passes through the openings 128, 130 and comes into contact with the bracket 164. The bracket 164 is aligned so that the finger 162 of the plunger 126 may pass through the opening 166 while the annular sleeve 160 is engaged by a bottom surface of the bracket 164. The annular sleeve 160 may be compressed between the bracket 164 and the base plate 120 as the finger 162 moves upwardly through the opening 166. The compression of the annular sleeve 160 creates the downward force on the base slat 46 for forcing the base slat 46 down into the side tracks 40 when the shutter curtain 30 is unrolled. The finger 162 eventually reaches the position shown in FIG. 21 wherein the eye 170 detects the presence of the finger 162 and causes the limit switch 168 to open and turn off the drive motor 102.

Figure 22:
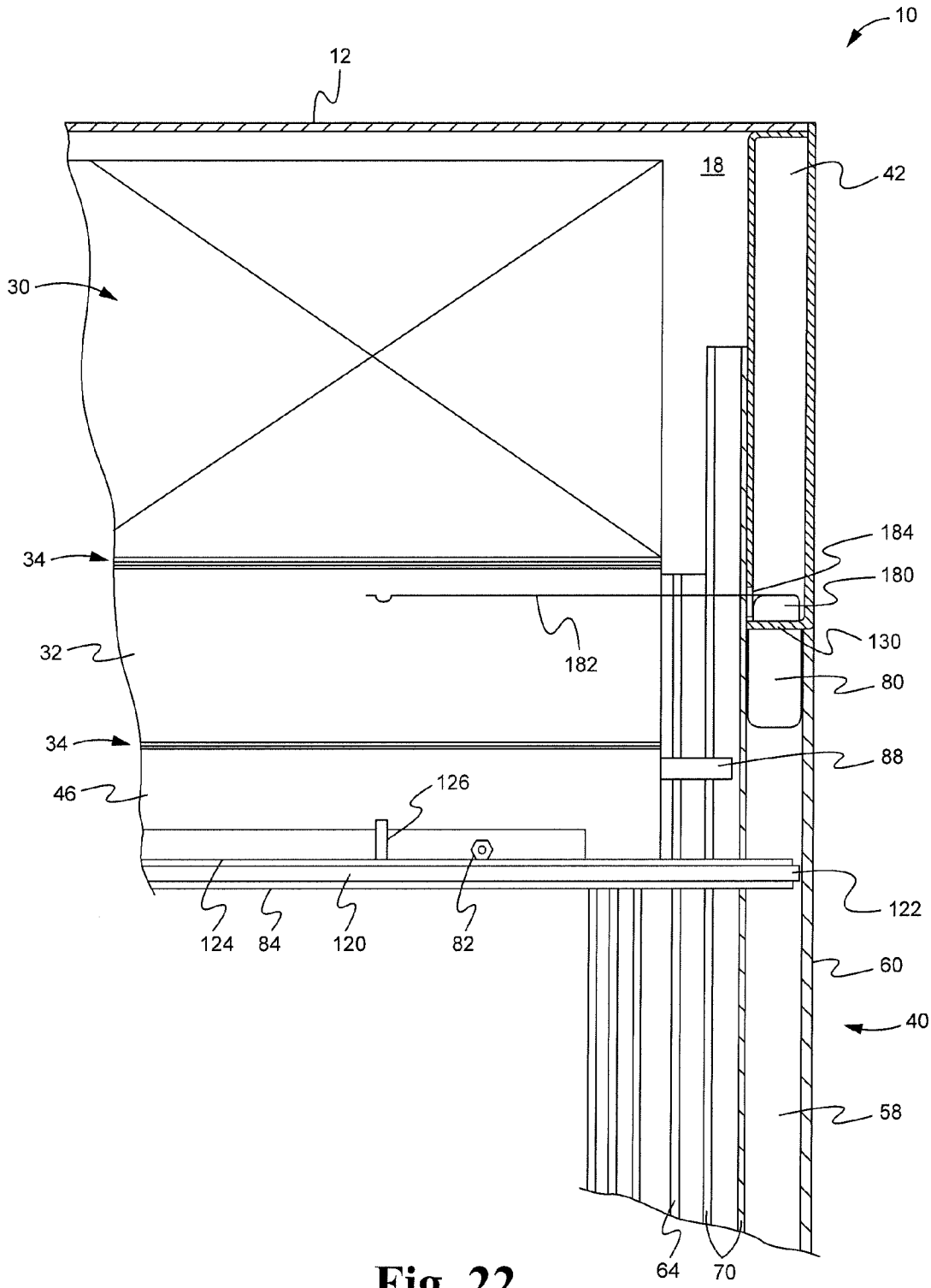
FIG. 22 is a front view of the upper right portion of a further embodiment of the shutter assembly of FIG. 11 with the front wall and bottom wall removed and the shutter support member not shown for clarity, and with the side track shown in cross-section taken along line 15-15 of FIG. 12.
Figure 23:
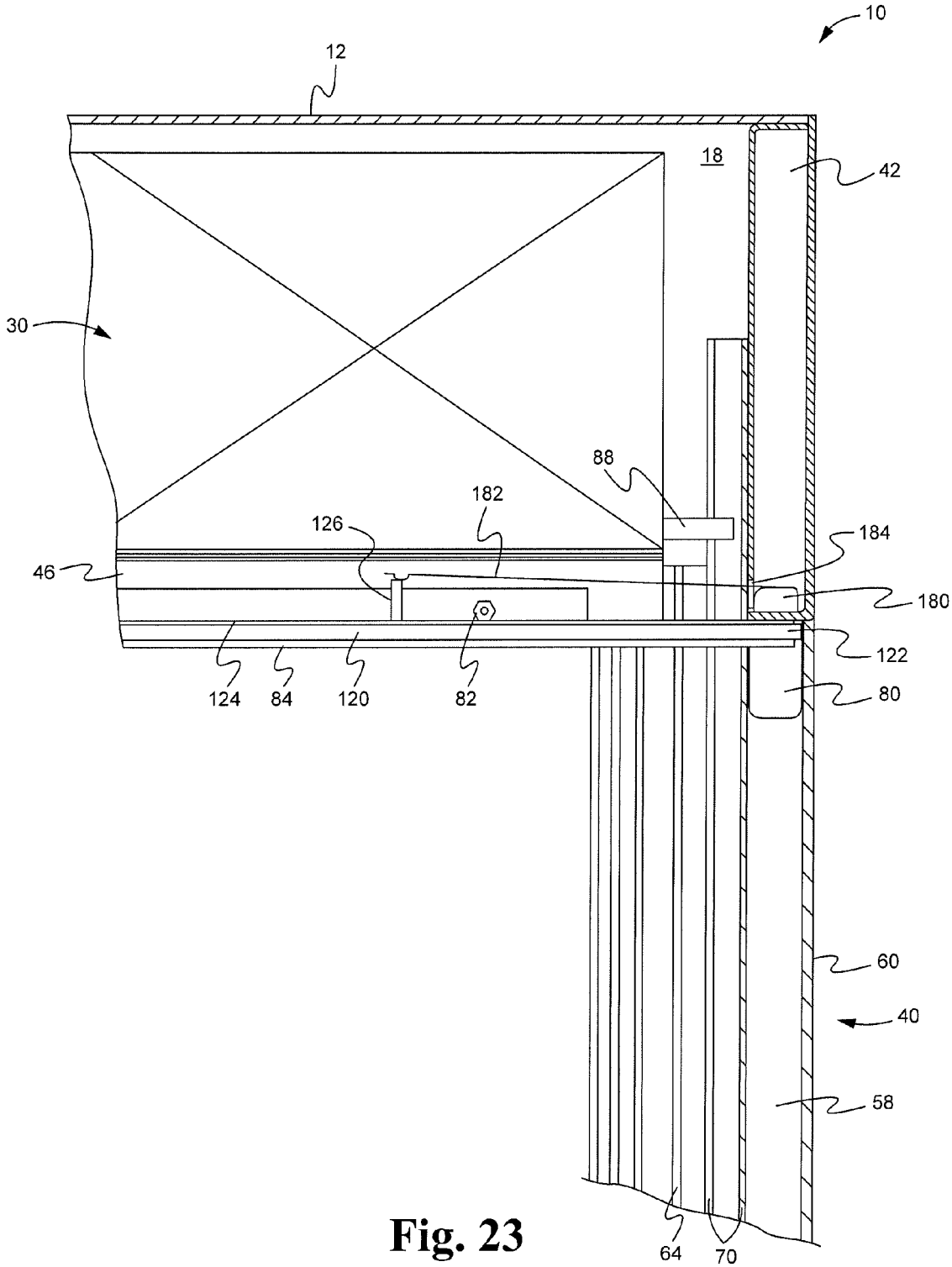
FIG. 23 is the front view of FIG. 15 with the shutter curtain rolled up to the upper limit position.

In the preceding examples, the limit switches and triggering mechanisms, whether electrical, electro-mechanical, pneumatic, optical or the like, have been disposed in either the shutter housing or in the drive motor housing 42 of the end cap 14. Those skilled in the art will understand that the portions of the shutter movement limiting mechanisms may be located in both the shutter housing and the motor housing 42. FIGS. 22 and 23 illustrate a further alternative embodiment of the rolling shutter assembly 10 wherein an electro-mechanical limit switch 180 may be mounted within the motor housing 42, and have an actuator arm 182 extending through an opening 184 through an interior wall of the motor housing 42 to a position within the shutter housing between the side tracks 40. The end of the actuator arm 182 may be disposed between front of the shutter curtain 30 and an edge of the bottom wall 19, or over a hole through the bottom wall 19. The plunger 126 is repositioned inwardly on the base plate 120 to align with the end of the actuator arm 182. If desired, the base plate extensions 122 may be omitted. As the shutter curtain 30 is rolled up onto the shutter support member 20, the base slat 46 approaches the rolled up portion of the shutter curtain 30 and the plunger 126 enters the shutter housing. The plunger 126 engages the actuator arm 182 and pushes the arm 182 upward until the limit switch 180 opens to shut off the drive motor at the position shown in FIG. 23. When the drive motor stops, the base slat 46 is positioned so that the gasket 124 may engage the bottom wall 19 of the shutter housing to close off the opening through which the shutter curtain 30 passes.

As with the other embodiments, the electro-mechanical limit switch 180 may be replaced by other types of switches capable of detecting the position of the base slat 46, such as pneumatic or optical switches. These switches may have accompanying triggering mechanisms configured to actuation the switches when the plunger 126 enters the shutter housing. In other embodiments, the plunger may be mounted on the triggering mechanism and extend downwardly through an opening of the shutter housing and be engaged by the base slat 46 or base plate 120 to trigger the opening of the limit switch 180. An optical switch may be positioned within the end cap 14 such that the entry of the plunger 126 into the shutter housing is detected without the need for an additional triggering mechanism. In these embodiments, installation of the limit switch 180 within the motor housing 42 of the end cap 14 allows the limit switch 180 to be prewired to the drive motor at the factory instead of the necessity of wiring the circuit in the field during installation, thereby simplifying the installation of the rolling shutter assembly 10.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A rolling shutter assembly for covering an opening of a structure, comprising:

a shutter housing mounted at the top of the opening and having a throw member opening;

a shutter support member mounted within the shutter housing;

a shutter curtain connected to the shutter support member at a top edge of the shutter curtain, the shutter curtain having a base slat connected to a bottom edge of the shutter curtain, wherein the shutter curtain is rolled up onto the shutter support member when the shutter support member rotates in a first direction and is unrolled from the shutter support member when the shutter support member rotates in a second direction;

a pair of side tracks mounted on opposite sides of the opening and receiving corresponding ends of the shutter curtain when the shutter curtain is unrolled;

a drive motor coupled to the shutter support member to rotate the shutter support member in both the first direction and the second direction;

a limit switch operatively connected to the drive motor and disposed within the shutter housing, the limit switch having a normal position allowing the drive motor to be actuated to rotate in the first direction and an actuated position preventing the drive motor from being actuated to rotate in the first direction; and a throw member disposed within the shutter housing, the throw member comprising:

a throw member bolt having a first bolt end disposed proximate the throw member opening of the shutter housing and a second bolt end disposed proximate the limit switch, a throw member bracket slidably receiving the second bolt end, and a biasing member operatively coupled to the throw member bolt and biasing the throw member bolt toward the throw member opening; and a plunger operatively connected to one of the base slat and the throw member and operatively engaging the other of the base slat and the throw member when at least a portion of the base slat is disposed within the shutter housing to cause the throw member bolt to move against the biasing force of the biasing member to a position to turn off the drive motor when the base slat is raised to a predetermined position within the shutter housing, wherein the biasing member provides a force moving the base slat downward in the side tracks when the shutter curtain is unrolled from the predetermined position of the base slat within the shutter housing.

2. The rolling shutter assembly as defined in claim 1, wherein the shutter housing comprises an end cap having a motor housing in which the drive motor and the limit switch are disposed, wherein the plunger is operatively connected to the throw member and is at least partially disposed within the shutter housing and external to the motor housing, and wherein the base slat engages the plunger as the base slat moves into the shutter housing as the shutter curtain is rolled up, and wherein the base slat causes the throw member to actuate the limit switch and turn off the drive motor.

3. The rolling shutter assembly as defined in claim 1, comprising a three-way switch operative connected to the drive motor and the limit switch, the three-way switch having an OFF position wherein the drive motor is not actuated, a DOWN position wherein the drive motor is actuated to rotate the shutter support member in the second direction, and an UP position wherein the drive motor is actuated to rotate the shutter support member in the first direction when the limit switch is in the normal position.

4. The rolling shutter assembly as defined in claim 1, wherein the limit switch is an optical switch positioned within the shutter housing to detect movement of a portion of the base slat within the shutter housing and to actuate in response to the movement of the portion of the base slat within the shutter housing to turn off the drive motor.

5. The rolling shutter assembly as defined in claim 1, wherein the plunger is operatively connected to the base slat with the plunger extending upwardly toward the shutter housing, wherein the throw member opening is positioned above the plunger, and wherein the plunger actuates the limit switch when the plunger is disposed within the shutter housing to turn off the drive motor.

6. The rolling shutter assembly as defined in claim 1, wherein the base slat has a guide arm extending outwardly from either side of the base slat, wherein the side tracks each have a first channel receiving a corresponding end of the shutter curtain when the shutter curtain is unrolled and a second channel receiving a corresponding guide arm of the base slat wherein the second channel of each side track extends above a top edge of the first channel of the side track and engages the corresponding guide arm of the base slat to cause the base slat to move vertically so that each end of the base slat remains disposed above the corresponding first channel when the base slat is disposed at the predetermined position within the shutter housing.

7. The rolling shutter assembly as defined in claim 1, wherein the base slat includes a base plate extending outwardly perpendicular to a plane of the shutter curtain, and wherein the base plate covers an opening in a bottom side of the shutter housing through which the shutter curtain passes when the base slat is disposed at the predetermined position within the shutter housing.

8. A rolling shutter assembly for covering an opening of a structure, comprising:

a shutter housing mounted at the top of the opening and having an end cap with a motor housing;

a shutter support member mounted within the shutter housing;

a shutter curtain connected to the shutter support member at a top edge of the shutter curtain, the shutter curtain having a base slat connected to a bottom edge of the shutter curtain and having a guide arm extending outwardly from either side of the base slat, wherein the shutter curtain is rolled up onto the shutter support member when the shutter support member rotates in a first direction and is unrolled from the shutter support member when the shutter support member rotates in a second direction;

a pair of side tracks mounted on opposite sides of the opening, each side track having a first channel receiving a corresponding end of the shutter curtain when the shutter curtain is unrolled and a second channel receiving a corresponding guide arm of the base slat, wherein the second channel extends upwardly into the shutter housing;

a drive motor disposed within the motor housing and coupled to the shutter support member to rotate the shutter support member in both the first direction and the second direction;

a limit switch operatively connected to the drive motor and disposed within the motor housing, the limit switch being normally closed to allow the drive motor to be actuated to rotate in the first direction and being open when actuated to prevent the drive motor from being actuated to rotate in the first direction;

a trigger mechanism disposed within the shutter housing, the trigger mechanism comprising:

a trigger mechanism bolt having a first bolt end disposed proximate the trigger mechanism opening of the shutter housing and a second bolt end disposed proximate the limit switch, a trigger mechanism bracket slidably receiving the second bolt end, and a biasing member operatively coupled to the trigger mechanism bolt and biasing the trigger mechanism bolt toward the trigger mechanism opening, and a trigger mechanism portion extending downwardly through a trigger mechanism opening in a bottom surface of the shutter housing, wherein the base slat engages the trigger mechanism portion to cause the throw member bolt to move against the biasing force of the biasing member to a position to actuate the limit switch to open the limit switch and turn off the drive motor when the base slat is raised to a predetermined position within the shutter housing, and wherein the biasing member provides a force moving the base slat downward in the side tracks when the shutter curtain is unrolled from the predetermined position of the base slat within the shutter housing.

9. The rolling shutter assembly as defined in claim 8, wherein the trigger mechanism portion comprises a plunger extending downwardly through the trigger mechanism opening in the bottom surface of the shutter housing and engaged by the base slat as the base slat approaches the predetermined position.

10. The rolling shutter assembly as defined in claim 8, wherein the shutter curtain comprises a plurality of individual slats and a plurality of hinges interconnecting the slats.

11. The rolling shutter assembly as defined in claim 8, comprising a three-way switch operative connected to the drive motor and the limit switch, the three-way switch having an OFF position wherein the drive motor is not actuated, a DOWN position wherein the drive motor is actuated to rotate the shutter support member in the second direction, and an UP position wherein the drive motor is actuated to rotate the shutter support member in the first direction when the limit switch is closed.

12. The rolling shutter assembly as defined in claim 8, wherein the base slat includes a base plate extending outwardly perpendicular to a plane of the shutter curtain, and wherein the base plate engages the trigger mechanism and covers an opening in a bottom side of the shutter housing through which the shutter curtain passes when the base slat is disposed at the predetermined position within the shutter housing.

* * * * *